US009135842B1

(12) United States Patent
Riley et al.

(10) Patent No.: US 9,135,842 B1
(45) Date of Patent: Sep. 15, 2015

(54) MOBILE DISPLAY AND ADVERTISING ASSEMBLY

(76) Inventors: Rachael Riley, Sebring, FL (US); Owen Batchelor, Sebring, FL (US); Philip Austin Riley, Sebring, FL (US); Stacey Albert Sorawat, Westfield, MA (US)

( * ) Notice: Subject to any disclaimer, the term of this patent is extended or adjusted under 35 U.S.C. 154(b) by 225 days.

(21) Appl. No.: 12/074,601

(22) Filed: Mar. 5, 2008

Related U.S. Application Data

(60) Provisional application No. 60/905,102, filed on Mar. 5, 2007.

(51) Int. Cl.
*G09F 21/04* (2006.01)

(52) U.S. Cl.
CPC ..... *G09F 21/04* (2013.01)

(58) Field of Classification Search
CPC ..... G09F 9/30; G09F 21/04; G09F 21/048
USPC ..... 345/7, 8, 1.2; 340/471, 472, 473, 468, 340/905, 988; 701/1, 200; 40/591
See application file for complete search history.

(56) References Cited

U.S. PATENT DOCUMENTS

| | | | | |
|---|---|---|---|---|
| 4,346,529 | A * | 8/1982 | Keller | 40/588 |
| 6,060,993 | A * | 5/2000 | Cohen | 340/691.6 |
| 6,222,447 | B1 * | 4/2001 | Schofield et al. | 340/461 |
| 6,880,276 | B2 * | 4/2005 | Strein et al. | 40/442 |
| 7,006,129 | B1 * | 2/2006 | McClure | 348/148 |
| 7,143,533 | B2 * | 12/2006 | Burke | 40/591 |
| 7,154,383 | B2 * | 12/2006 | Berquist | 340/425.5 |
| 2004/0192351 | A1 * | 9/2004 | Duncan | 455/456.3 |
| 2005/0072350 | A1 * | 4/2005 | Aasgaard | 116/259 |
| 2005/0134441 | A1 * | 6/2005 | Somuah | 340/435 |
| 2005/0192744 | A1 * | 9/2005 | Maqui et al. | 701/211 |
| 2006/0244829 | A1 * | 11/2006 | Kato et al. | 348/148 |
| 2008/0030427 | A1 * | 2/2008 | Lanham | 345/2.3 |

FOREIGN PATENT DOCUMENTS

GB 2299870 A * 10/1996

* cited by examiner

*Primary Examiner* — Amare Mengistu
*Assistant Examiner* — Stacy Khoo
(74) *Attorney, Agent, or Firm* — Ronald V. Davidge

(57) ABSTRACT

A vehicle mounted display system generating advertising and/or other displayed messages which are clearly viewable from at least a rear exterior vicinity of the vehicle. An electronically powered display may comprise a digital display screen, such as an LCD, or a mechanically driven but electronically powered scrolling assembly. A mounting assembly selectively disposes the display assembly between operative and stored positions and a viewing assembly including at least one camera disposed to observe exterior areas which are obstructed by the operatively positioned display assembly. The viewing assembly also comprises a camera display disposed to be clearly viewable by the vehicle operator enables the operator to the view the obstructed areas.

15 Claims, 27 Drawing Sheets

Retractable Treatment

Retractable Treatment

Retractable Treatment

Retractable Treatment

Retractable Treatment

Retractable Treatment

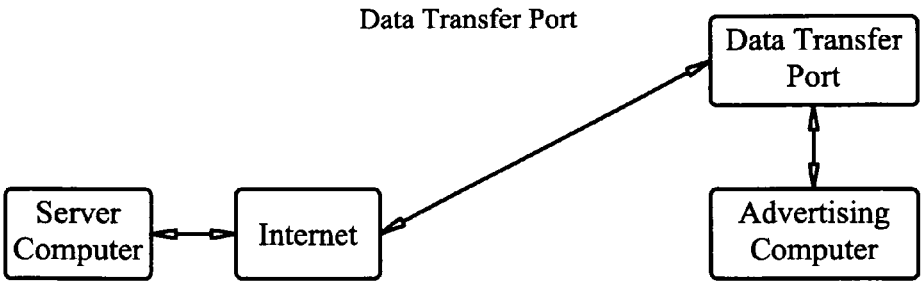

FIG. 48

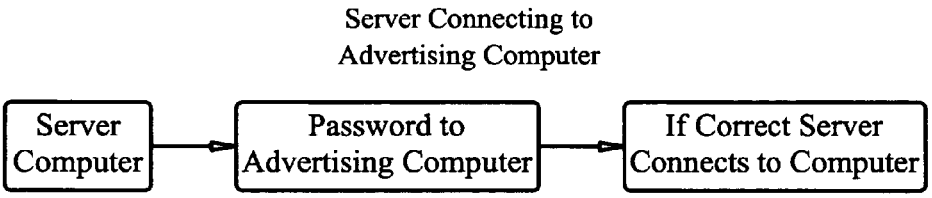

FIG. 49

Computer Display Screen
(the corresponding box lights up when that mode is activated)

Control Button (User Presses Buttons with Touch Screen.)
1. Motor Button
2. Motor Stop Button
3. Manual Mode
4. Automatic Mode
5. Pin Button
6. Emergency Power off Button System Status (statuses Highlighted when Activated.)
1. Manual Mode
2. Automatic Mode
3. 'advertising display stored'
4. 'advertising display deployed'
5. 'pins locked'
6. Pins Unlocked System Deactivation Mode

FIG. 50

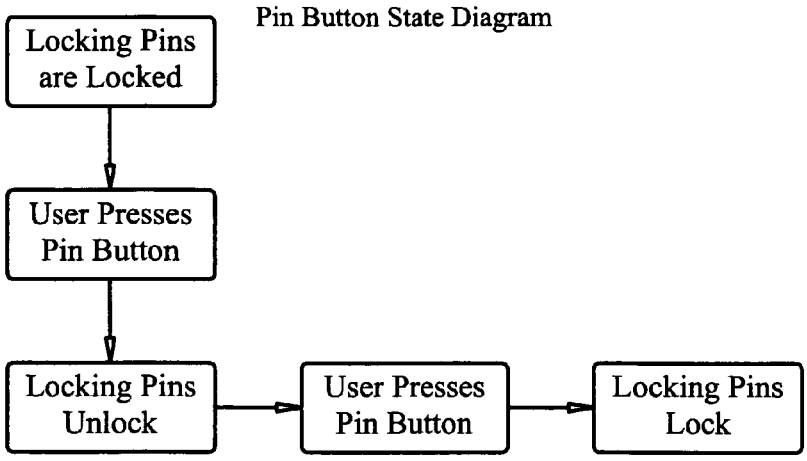

FIG. 51

Electric Motor Operation State Diagram

| | | |
|---|---|---|
| 1. | Stored sensor is activated | Advertising display is deployed status is on. |
| 2. | User presses Motor button | Electric motor runs until advertising display is deployed sensor activates and turns off electric motor and turns on deployed status. |
| 3. | User presses Motor button | Electric motor runs in reverse until advertising display is stored sensor activates and turns off electric motor and turns on stored status. |

Repeat, Back to step one.

FIG. 52

MOBILE DISPLAY AND ADVERTISING ASSEMBLY

CLAIM OF PRIORITY

The present application is based on and a claim of priority is made under 35 U.S.C. Section 119(e) to a provisional patent application that is currently in the U.S. Patent and Trademark Office, namely, that having Ser. No. 60/905,102 and a filing date of Mar. 5, 2007, and which is incorporated herein by reference.

BACKGROUND OF THE INVENTION

Field of the Invention

The present invention relates to a mobile display and/or advertising assembly adapted for use on any of a plurality of motor vehicles and including a display assembly. Advertising or other displayed messages may be clearly observable from the exterior of the vehicle when the display assembly is in an operative position. Any obstructed view of the vehicle operator is overcome by a viewing assembly comprising at least one appropriately placed camera and a camera display observable by the vehicle operator.

SUMMARY OF THE INVENTION

This invention relates to a mobile display system and more specifically to a system for displaying advertising and/or other messages on a predetermined portion, such as the rear, of a vehicle. Accordingly, the advertising and other displayed content are clearly viewable from at least the rear exterior vicinity of the vehicle by both pedestrians and surrounding vehicular traffic.

In its various preferred embodiments, the display system includes an electronically powered display assembly which may comprise a digital display screen, such as an LCD. Alternatively, the display assembly may comprise a mechanically driven but electronically powered scrolling "billboard" assembly. A mounting assembly serves to selectively dispose the display assembly into either an operative position or a stored position at the choice of the vehicle operator.

A viewing assembly comprises at least one camera connected to the vehicle and disposed and structured to facilitate observation by the vehicle operator of exterior areas of the vehicle which are obstructed by the display assembly when in the operative position. The viewing assembly also comprises a camera display disposed at any of a plurality of different locations on the vehicle which facilitate clear and safe viewing by the vehicle operator. As such, the operator is provided clear, safe and accurate observation of the areas on the exterior of the vehicle which are obstructed by the operatively positioned display assembly.

More specifically, the various preferred embodiments of the display system of the present invention include a digital display screen such as, but not limited to, an LCD display which may be located both exteriorly or interiorly of the vehicle and/or a scrolling print display which also may be located both interiorly or exteriorly of the vehicle. While each of these preferred embodiments has distinguishing structural and operative features, they are all representative of a display system which is readily adaptable for use with a variety of motor vehicles such as taxis, buses, tractor trailers as well as more conventional, non-commercial passenger vehicles of various types. In at least some of the preferred embodiments, as set forth above, the use of an LCD display would employ technology such as a wide viewing angle lens, lighting, etc.

Such features facilitate the ability to clearly view the display assembly from a predetermined location or area on the exterior of the vehicle, regardless of the ambient viewing conditions. In certain additional preferred embodiments, the electronic digital display and/or LCD screen can be equipped or operatively structured to display three dimensional images.

In certain embodiments of the mobile display and/or advertising system being used, the presence of a viewing assembly is an accompanying, operative feature. Moreover, the viewing assembly facilitates the implementation of the display and/or advertising system of the present invention by rendering operation of the vehicle completely safe when the display assembly is in an operative position. More specifically, the viewing assembly of the present invention comprises at least one camera mounted on the vehicle in an appropriate, predetermined location, which provides a clear viewing of obstructed areas by the vehicle operator.

As will be emphasized herein, the operator's view of at least some exterior areas surrounding the vehicle may be obstructed at least partially due to the placement the display assembly in an operative position. Accordingly, the one or more cameras defining a part of the viewing assembly are preferably located so as to view these obstructed areas. Depending on the application of the various preferred embodiments of the display system, the viewing assembly may be disposed to view at least rear areas of the vehicle, while it is traveling and during operation and presentation of the viewing assembly. Again, dependent on the particular embodiment applied, the operatively positioned display assembly will almost certainly obstruct the vision or external viewing of the operator which would normally be clear.

In addition, the viewing assembly further includes a camera display and/or camera display screen, which is operatively associated with the one or more cameras, as set forth above. Moreover, the camera display presents a full view of the obstructed viewing area to the vehicle operator. The camera display may be disposed in any of a plurality of readily observable positions on or within the vehicle. Such appropriate locations for the camera display include a position which is substantially adjacent the rear view window of the vehicle and in corresponding relation to the display assembly. Alternatively, the camera display may be mounted adjacent to or in direct association with a rear view mirror whether the rear view mirror is located inboard or outboard of the vehicle. In addition, a camera display screen may be directly associated with a navigation system of the vehicle, wherein such navigation systems are becoming increasingly available to both passenger and commercial vehicles. Absent the presence of a navigation system, the camera display may be also located or mounted on a portion of the dashboard of the vehicle in an area which is readily observable by the operator during travel of the vehicle. The above noted possible locations of the camera display are not intended to be limiting but rather are representative of a number of camera display locations of which may be quickly, easily, efficiently and safely viewed by the operator of the vehicle during travel.

Additional structural and operative features of the display system of the present invention includes a provision of a mounting assembly which may vary in structure but which has an overall function to selectively dispose the various embodiments of the display assembly into either an operative position or a stored position. The structure and operation of the mounting assembly may vary in terms of one or more drive motors or like drive devices and/or associated mechanical linkage cooperatively functional therewith. Such structural components should be operative to assure a selective and precise positioning of the display assembly in either the operative or stored positions as determined by the operator.

Somewhat related to the selective positioning of the display assembly is the provision of a storage area which may be located either exteriorly or interiorly of the vehicle. The location and other physical characteristics of the storage area may differ based, at least in part, on which of the aforementioned display assemblies are utilized and applied to the vehicle, as well as the overall structure of the vehicle itself. By way of example, an interior location of the display assembly is such that the aforementioned storage area may be defined by the interior of a trunk portion of the vehicle or a compartment disposed where the vehicle trunk is normally located. In contrast, an exteriorly mounted display assembly may be used in combination with a storage area located exteriorly of the vehicle. As such, the exteriorly mounted storage area may be defined by an auxiliary compartment located on an appropriate exterior portion of the vehicle, such as on a roof portion thereof.

Additional preferred embodiments of the present invention comprise the display assembly located on a conventional passenger type vehicle which typically does not include a trunk or other convenient or conventional segregated storage area. Such vehicles include sports utility vehicles (SUV), vans or the like. As set forth in greater detail hereinafter, the display assembly of the present invention and the various structural components associated therewith may be modified at least to the extent that the display assembly will be at least partially disposed on or directly associated with rear door of the vehicle. Further, in such additional embodiments the display assembly may be defined by either a stationary or retractable mounting on the vehicle's rear door in direct association with the rear window. Accordingly, the display assembly may include the display screen being defined by the rear window which is either stationary or retractable relative to the rear door, dependent on the style, model etc. of the vehicle. Therefore, when the window is retractable, the display assembly associated therewith may be selectively disposed in an operative, viewing position or a retracted position.

As set forth above and described in further detail hereinafter, the display system of the present invention comprises an electronic display assembly, which may assume variations of the digital displays and/or printed billboard scrolling assembly. In the latter embodiment, the scrolling assembly, while being electronically powered, may still be mechanically driven such as by the inclusion of rotating spools, drive motors, mechanical linkage, etc. Electric energy or power which serves to power the display system of the present invention may be derived directly from the battery or like power supply associated with the vehicle itself. In the alternative, the display assembly of the present invention can be at least partially self sufficient by including an independent power supply/battery pack assembly. Yet additional variations and modifications of electronic power sources would be batteries or other applicable sources of electrical energy which may be powered, recharged or restored. Moreover, the use of a solar system, mounted directly on the vehicle or at other appropriate sites could be operative to serve as a direct primary energy source through the use of photovoltaic cells or other appropriate structuring. Alternatively, such a solar power system could be used to charge battery capabilities of the type set forth above and or drive independent generator assemblies.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIGS. 1-6 are schematic representations of a display system of the present invention specifically directed to a display assembly and a viewing assembly mounted on a vehicle.

FIG. 48 is a schematic representation of a communications aspect of the present invention directed towards data transfer port technology.

FIGS. 49-51 are schematic representations of yet another embodiment of the display system of present invention directed towards operative computer technology associated with the present invention.

FIGS. 52-54 are schematic representations directed towards electric motor operation, motor assembly and computer operational procedures with the above-noted embodiments of the present invention.

Like reference numerals refer to like parts throughout the several views of the drawings.

DETAILED DESCRIPTION OF THE PREFERRED EMBODIMENT

Figure 1:
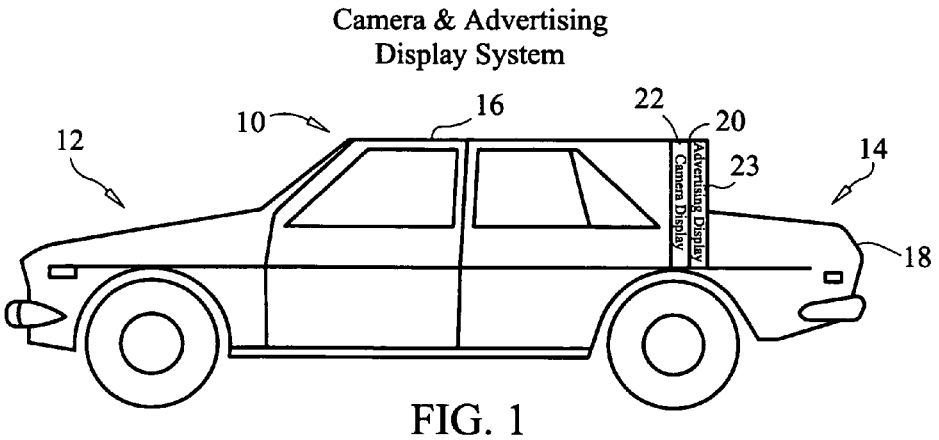

The present invention is directed to a display system structured to be mounted on a vehicle including, but not limited to, commercial vehicles such as taxis, buses, tractor trailers, etc. as well as domestic vehicles comprising conventional passenger vehicles including sports utility vehicles (SUV), Vans, etc. It should be apparent that the display system of the present invention may be adaptively structured to accommodate the type, size, operation and structure of the vehicle on which it is mounted or with which it is used.

Accordingly, the display system comprises a plurality of different preferred embodiments of a display assembly at least some of which are independently referred to herein as a digital in-vehicle scroll assembly; a digital outside scroll assembly; a print in-vehicle scroll assembly and a print outside scroll assembly. While each of these preferred embodiments may be used with a variety of different vehicles and for a variety of different purposes, certain operative and structural components associated with the various preferred embodiments may be interchangeable and/or functionally or operationally indistinguishable to facilitate a proper operation thereof. Moreover, common structural and operative features of at least some of the preferred embodiments of the display assembly include them being electronically powered. Further, various preferred embodiments of the display assembly may be disposed either interiorly or exteriorly on the vehicle. In either location viewing of the displayed advertising or other message may be clearly and effectively viewed from the exterior of the vehicle, regardless of ambient viewing conditions, as long as the display assembly is in its operative position.

In addition, in at least some embodiments the display system and/or assembly of the present invention includes a mounting assembly structured to adjustably interconnect the display assembly to the vehicle and further structured to selectively position the display assembly between the operative position for viewing and a stored position. As will also be apparent, when the display assembly is in an operative position, certain normally observable portions of the viewing field of the vehicle operator are obstructed. In order to facilitate safe operation of the vehicle while the display assembly is in an operative position, each of the preferred embodiments of the display assembly is used with a viewing assembly.

The viewing assembly is connected to the vehicle and is structured to facilitate observation of the obstructed exterior areas of the vehicle so that a normal field of vision is restored to the vehicle operator while the vehicle is in operation. As will also be set forth in greater hereinafter, the viewing assembly includes at least one camera, or possibly a plurality of cameras, appropriately mounted at various locations on the vehicle. The camera location is such that the obstructed viewing areas or regions on the exterior of the vehicle are clearly captured by the camera. Moreover, the viewing assembly also includes a camera display for displaying the field of vision observed by the camera. The camera display may be located in any of a plurality of positions on and/or within the vehicle. Each of the possible plurality of locations of the camera display facilitates a quick, efficient and safe observation thereof by the vehicle operator during travel of the vehicle.

With specific reference to the accompanying drawings, a first of a plurality of preferred embodiments of the display system of the present invention is represented in FIGS. 1-6A. This preferred embodiment comprises the aforementioned digital in-vehicle scroll assembly. As such, a vehicle is schematically represented and generally indicated as 10. The vehicle 10 includes a front portion generally indicated as 12 and a rear portion generally indicated as 14. A roof or upper portion of the vehicle 10 is indicated as 16 and a trunk or like conventional storage portion of the vehicle is indicated as 18. Accordingly, this preferred embodiment of the display system includes a display assembly 20 which may be selectively disposed in the operative position of FIG. 1 or the stored position of FIG. 2. When in the operative position of FIG. 1, the display assembly 20 may be disposed adjacent to or in direct association with a rear window 23 of the vehicle 10. As should be apparent placement of the display assembly 20 in this location will serve to obstruct at least a portion of the normal field of vision of a vehicle operator when attempting to view the surrounding external conditions associated with and/or beyond the rear portion 14.

Figure 2:
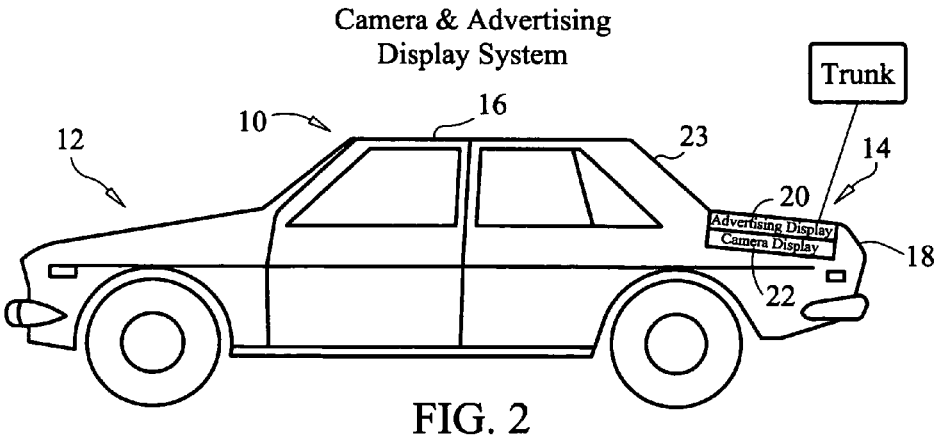
Figure 3:
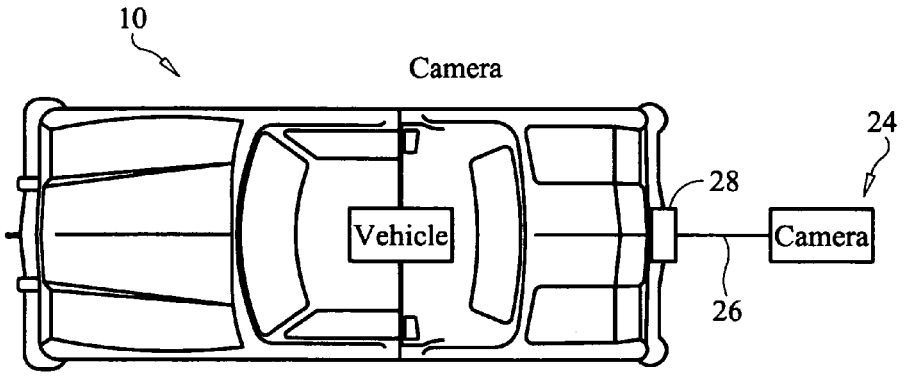
Figure 4:
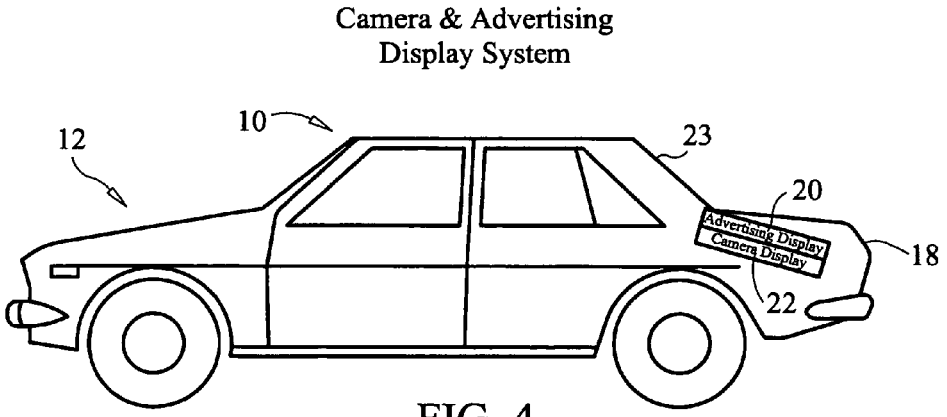
Figure 5:
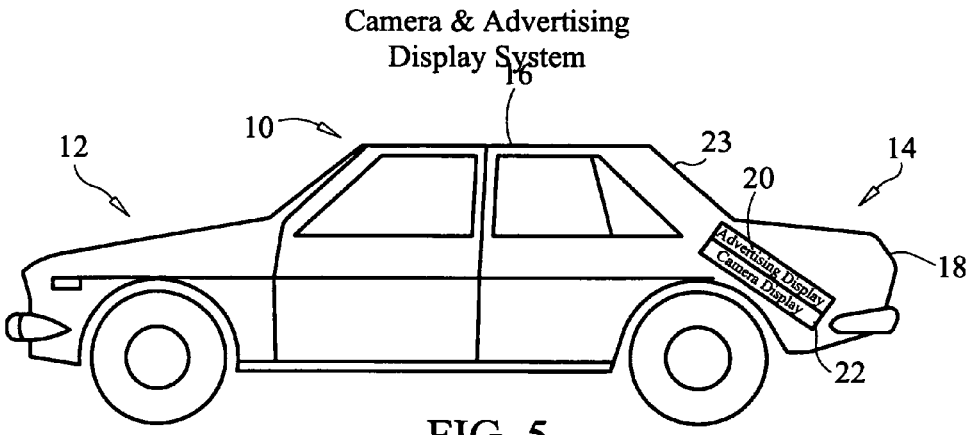
Figure 6A:
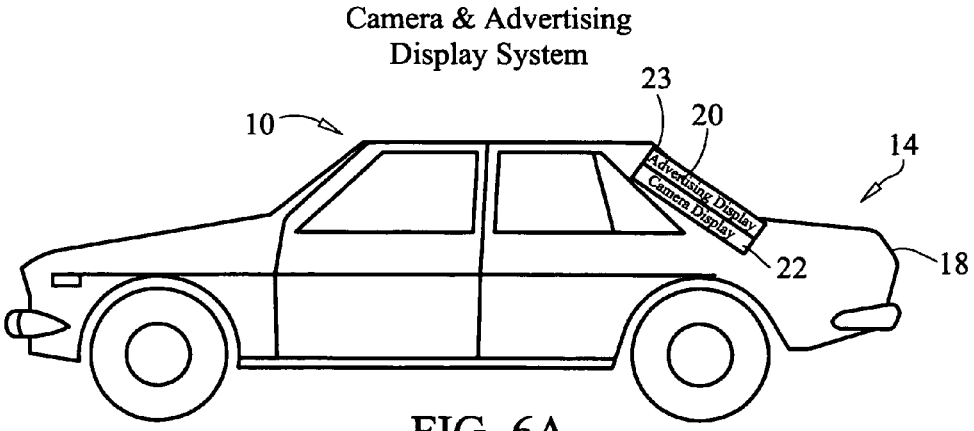
FIGS. 6A-6B are schematic representations of structural and operative modifications and varying positions of the display assembly and viewing assembly associated with the embodiments of FIGS. 1-5.
Figure 6B:
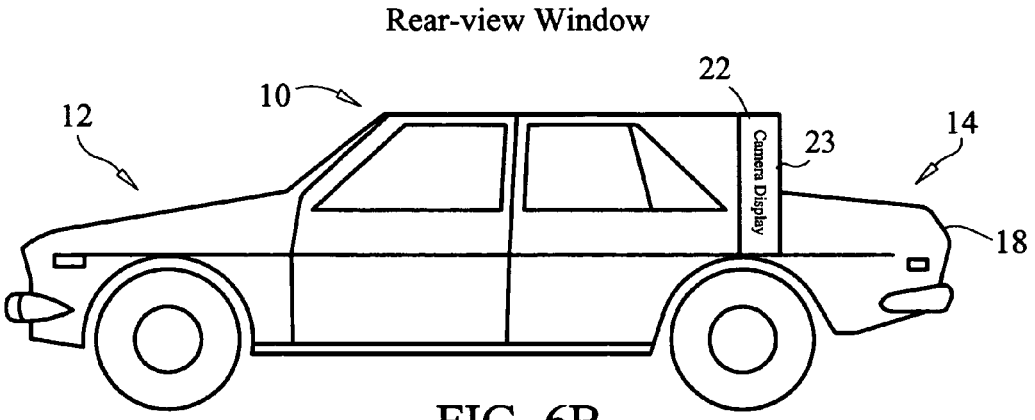

Accordingly, in order to provide a clear and complete viewing of the areas obstructed by the display assembly 20, a viewing assembly is provided, so as to assure safe operating conditions of the vehicle. With reference to FIGS. 1-3, the viewing assembly includes at least one camera generally indicated as 24 and a camera display generally indicated as 22. The camera 24 may be connected to or mounted on any appropriate portion of the vehicle 10 which facilitates it capturing a complete view of the obstructed areas. As set forth above, the obstructed view of the vehicle operator may vary based at least in part on the display assembly 20 being disposed in the operative position of FIG. 1. The viewing assembly may also include appropriate operative interconnections 26 and an operating or control assembly 28 associated with the camera 26 and/or camera display 22 to facilitate proper operation of the viewing assembly.

Other features to be described in greater detail hereinafter with specific reference to the digital in-vehicle scroll assembly preferred embodiment, as well as other preferred embodiments of the display assembly include a mounting assembly. The mounting assembly while varying in structure and operation is disposed to selectively position the display assembly 20 between the operative position of FIG. 1 and the stored position of FIG. 2. Accordingly, the display system or assembly of the present invention further comprises a storage area including the trunk portion 18 of the vehicle 10, as represented in FIG. 2. If the vehicle 10 is absent a specific trunk portion, a similarly located storage compartment disposed generally in the normal vicinity of the trunk portion will suffice. The selective positioning of the display assembly 20 between the operative position of FIG. 1 and the stored position of Figure is accomplished by the aforementioned mounting assembly. As contemplated and described in detail hereinafter, the mounting assembly may include appropriate mechanical linkage which may or may not be electrically powered. For purposes of clarity, the specific linkage associated with the mounting assembly of the embodiment of FIGS. 1-3 is not represented. However, such linkage is clearly and schematically represented in additional accompanying Figures, wherein such mechanical linkage of the mounting assembly is readily adaptable to the embodiment of FIGS. 1-3.

As set forth above, the display assembly 20 and/or any camera display 22 associated therewith upon operation of the mounting assembly may be concurrently disposed between the operative and stored positions as set forth above. Accordingly, with reference to FIGS. 4-6A, the display assembly 20 and the camera display 22 are represented as moving successively along a path of travel as it is being removed from its stored position within trunk 18 to the operative position of FIG. 1. Further, the structure, disposition and performance characteristics of the mounting assembly and the mechanical linkage associated therewith is such as to accomplish passage along a reverse path of travel as the display assembly 20 is moved from the operative position of FIG. 1 to the stored position of FIG. 2.

As set forth above, the location of the camera display may vary but the requirement for eventual location selected is that the vehicle operator can clearly observe the camera display especially during operation of the vehicle. In addition, the various positions of the camera display may be at least partially dependent on the particular preferred embodiment of the display assembly utilized and/or the various physical and operative characteristics of the vehicle.

Figure 7:
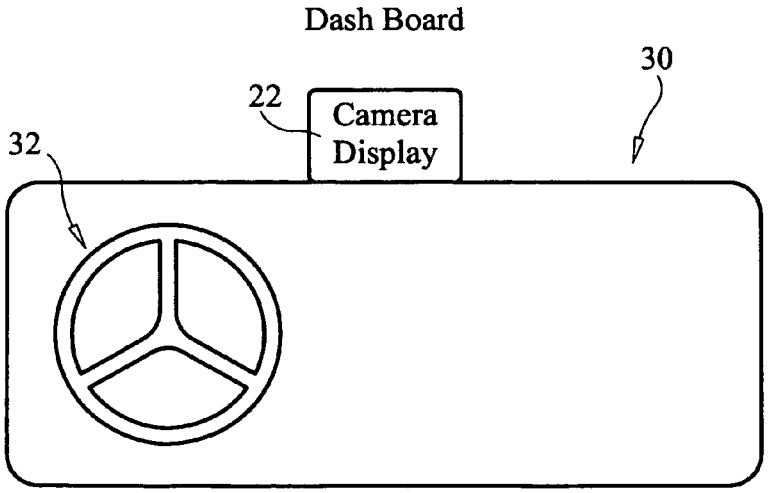
FIGS. 7-9 are schematic representations of various details as well as structural and operative components of the viewing assembly including a camera display in the various locations on or within a vehicle.
Figure 8:
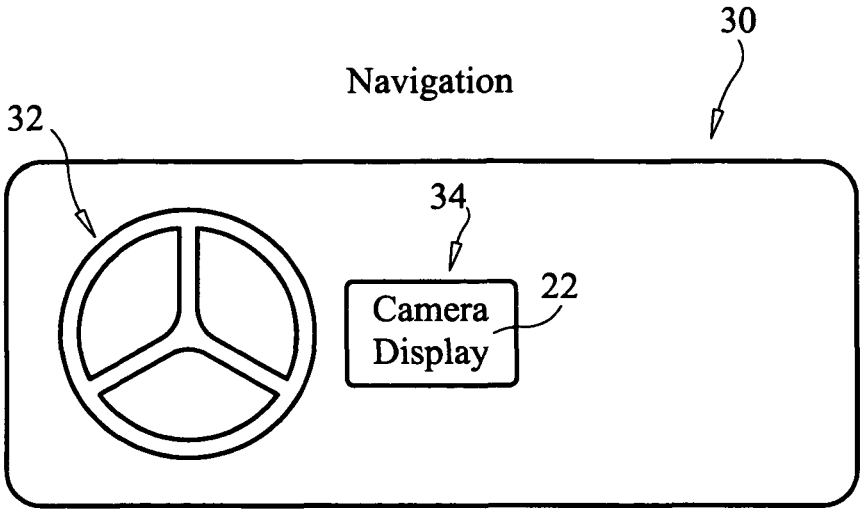
Figure 9:
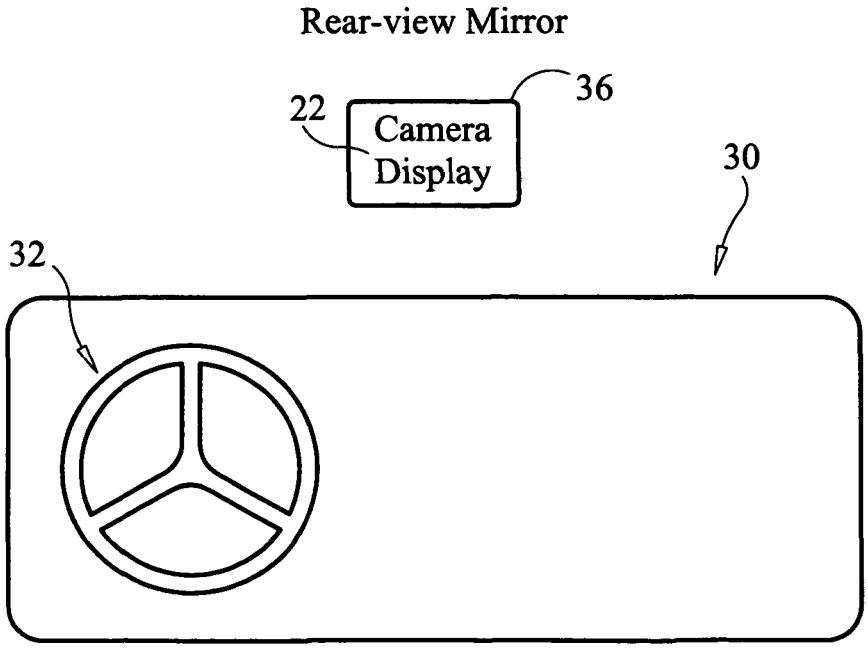

With primary reference to FIGS. 1-9, the camera display may be located adjacent to or in direct association with the rear portion of the vehicle 10 such as, but not limited to, adjacent the rear window 23. In contrast, FIG. 7 represents the camera display 22 mounted on or adjacent to the dashboard 30 of the vehicle 10 in the general vicinity of a driver's location, steering wheel, etc. as generally indicated at 32. Somewhat similarly, the camera display 22 may be directly associated with a navigation system which is commonly found in a variety of different commercial and domestic vehicles. Moreover, navigation systems 34 of the type referred to are generally mounted on or generally associated with the dashboard 30. Another possible location of the camera display 22, as represented in FIG. 9, is it being mounted on, connected to or disposed in general association with a rear view mirror 36. In this embodiment the rear view mirror 36 is located on the interior of the vehicle above or in the general vicinity of the dashboard 30 and adjacent the position of the vehicle operator as at 32. Although not specifically represented in the accompanying Figures, it is further contemplated that the camera display 22 may be connected in association with a side rear view mirror.

Figure 10:
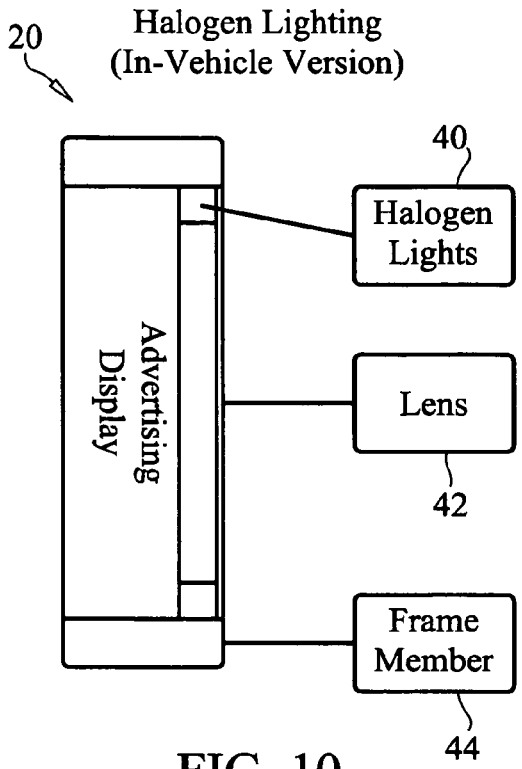
FIG. 10 is a schematic representation of a halogen lighting embodiments of FIGS. 1-9.

As set forth above, the various preferred embodiments of the display assembly 20 may include a digital display, whether located within the vehicle or on the exterior thereof. More specifically, the display assembly 20 may comprise and or be at least partially defined by a number of different display structures including, but not limited to, a variety of digital or analog displays including single or multi-panel display screens, which may or may not have three dimensional (3D) capabilities; scrolling or otherwise movable or fixedly disposed signage and/or billboard structures, etc. By way of example, one preferred embodiment of the display assembly 20 may be in the form of an LCD assembly comprising a variety of additional features which facilitate viewing of the display assembly 20 from a predetermined location or area on the exterior of the vehicle 10. With reference to FIG. 10 the display assembly 20, whether or not in the form of an LCD assembly, may be further structured to include halogen lighting 40, an appropriate lens system 42 and a supporting frame member 44. An LCD of the display assembly 20 which includes the halogen lighting feature 40 may be primarily used with the digital in-vehicle scroll assembly but may also be used for other preferred embodiments, as set forth in greater detail hereinafter. Yet other features associated with the display assembly 20 may include an LCD display being "built-in" or otherwise structured to be a part of the vehicle's rear window. In such an embodiment, as with other embodiments of the display assembly 20 comprising an LCD display, it is able to generate or display multiple advertisements, messages communications, etc. Moreover, the display assembly 20 may comprise a plurality of LCD displays each being similarly built in or otherwise structured to be a part of a different one of the plurality of windows of the vehicle, in addition to or instead of the rear window.

Figure 11:
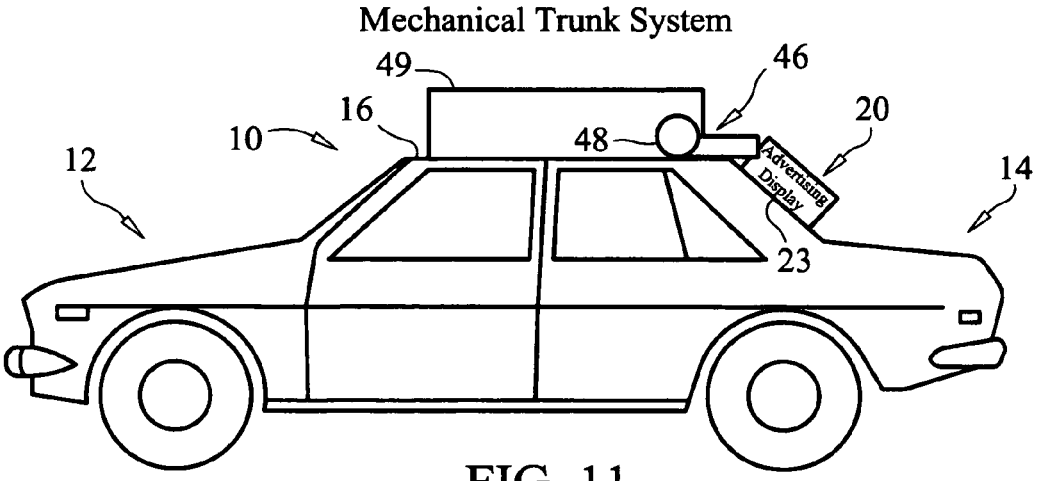
FIGS. 11-17 are schematic representations of a mechanical trunk system of the display system of the present invention wherein a trunk of a vehicle is used as a storage area for the display assembly when in a stored or non operative position.
Figure 12:
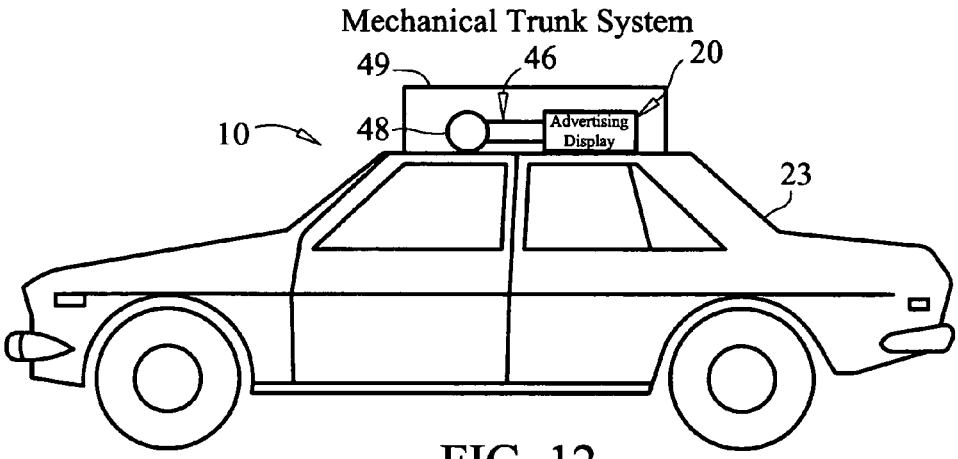
Figure 13:
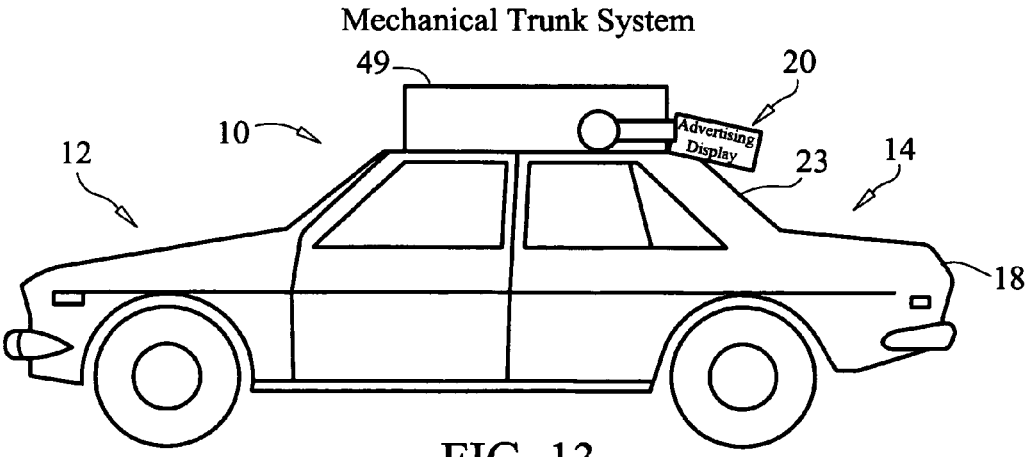
Figure 14:
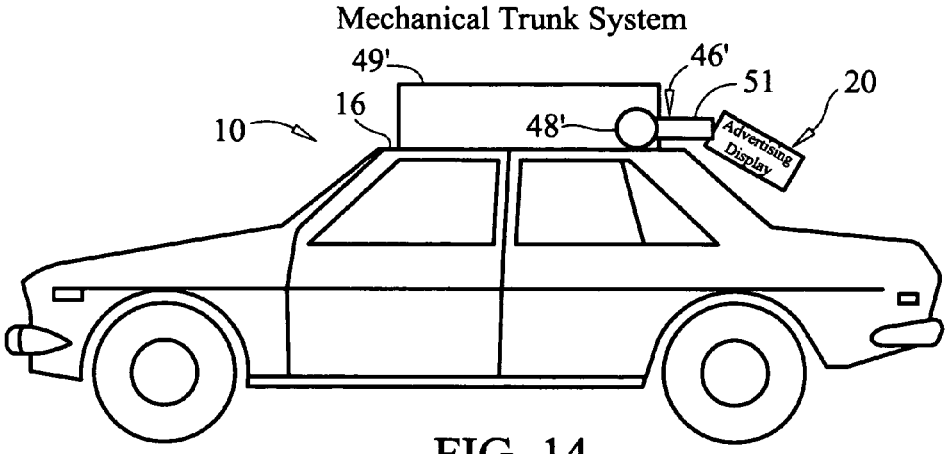
Figure 15:
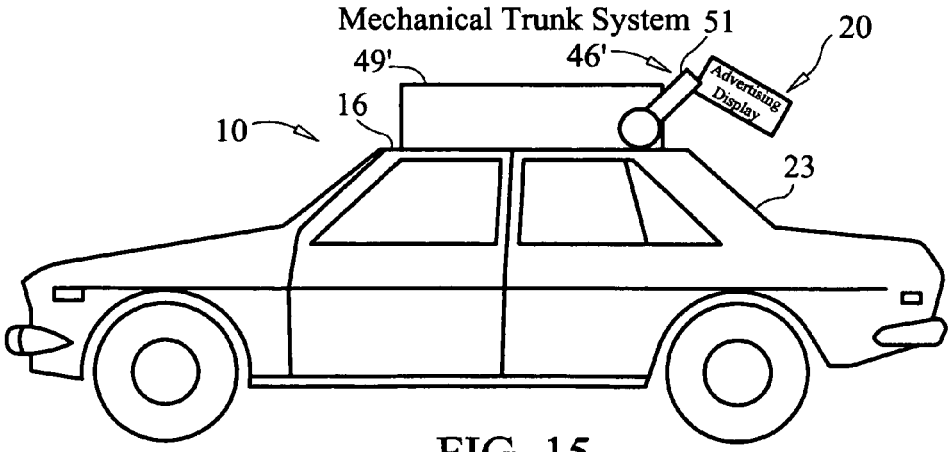
Figure 16:
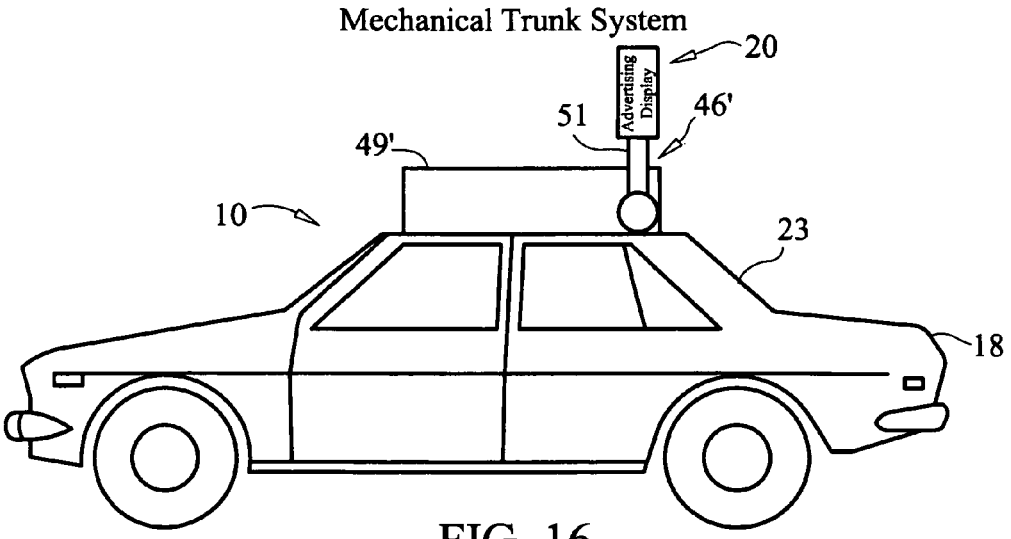
Figure 17:
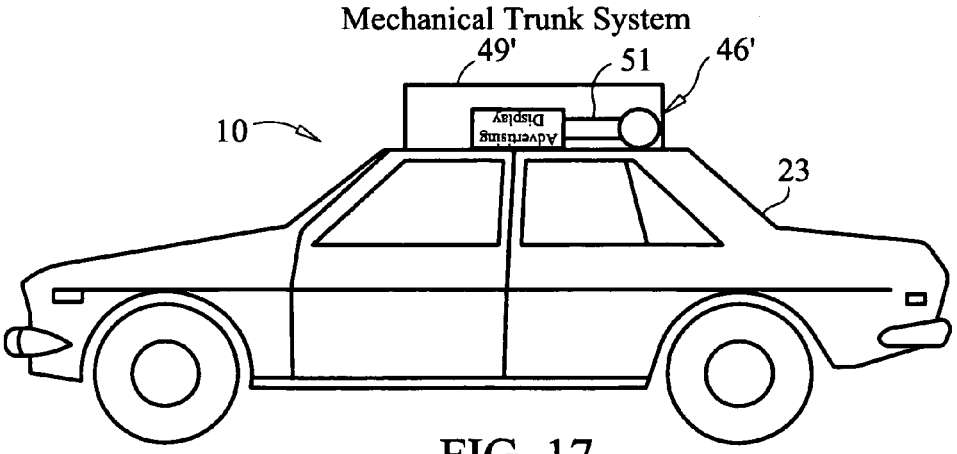

As set forth above, another preferred embodiment of the display assembly comprises a digital outside scroll assembly which may also incorporate an LCD display assembly of the type generally set forth above. However, in this preferred embodiment the LCD display of the display assembly 20 is located exteriorly of the vehicle as indicated in FIG. 11. FIG. 11 further represents the display assembly 20 in its operative position and being cooperatively disposed and structured with a mounting assembly generally indicated as 46. The mounting assembly comprises an appropriately structured mechanical linkage 48 capable of selectively disposing the display assembly 20 between an operative position as represented in FIG. 11 and a stored position represented in FIG. 12. FIG. 13 represents the display assembly 20 being selectively positioned into and out of both the operative position of FIG. 11 and the stored position of FIG. 12. Selective positioning of the display assembly 20 between the operative and stored positions is accomplished by a control assembly, to be described in greater detail hereinafter. The control assembly is readily accessible by the vehicle operator or other individuals on the interior of the vehicle 10, as will be clearly represented. Further, a storage area generally indicated as 48 is associated with the digital outside scroll assembly represented in FIGS. 11-13 and differs from the storage area being defined by the trunk portion 18 of the vehicle 10. More specifically, the storage area 49 may be an auxiliary compartment, chamber, etc. located at various locations on the vehicle 10. In the embodiment of FIGS. 11-13, the storage area 49 may be located on or adjacent to the roof portion 16 of the vehicle 10 or at any other appropriate location, as set forth above.

With primary reference to FIGS. 14-17 another structural and operative variation of the mounting assembly is indicated as 46'. More specifically, the mounting assembly 46', which also may be associated with the digital outside scrolling assembly, is selectively operable to position the display assembly 20 in either the operative position of FIG. 11 or a stored position represented in FIG. 17. Further, the storage area is generally indicated as 49' and is again preferably, but not necessarily, connected to, mounted on or otherwise associated with a roof portion 16 of the vehicle 10. As such, the additional preferred embodiment of the mounting assembly 46' is such that the mechanical linkage 48' includes a "mechanical arm" or like structure 51. The mechanical arm 51 is powered by at least one drive motor. Further, the arm 51 is connected to and at least partially supports the display assembly 20 as it moves from its operative position of FIG. 11 sequentially into the stored position of FIG. 17, wherein it is retained within the storage area 49'. More specifically, when the display assembly 20 is moved into the stored position of FIG. 17, it is retracted or otherwise appropriately moved such that the mechanical arm 51 "flips" the display assembly 20 into the storage area 49'. In such a stored position, the back or underside of the display assembly 20, as well as other portions thereof, correspond in dimension and configuration with interior portions of the storage area 49'. Further, the back or underside of the display assembly 20 may form a waterproof seal with the storage area with corresponding or structural portions of the storage area 49'.

It is also to be noted that the preferred embodiment defined by the digital outside scroll assembly may include the aforementioned camera display 22 being disposed in a variety of appropriate locations within the vehicle or at least partially on the exterior thereof as described above and schematically represented in FIGS. 6-9.

Figure 18:
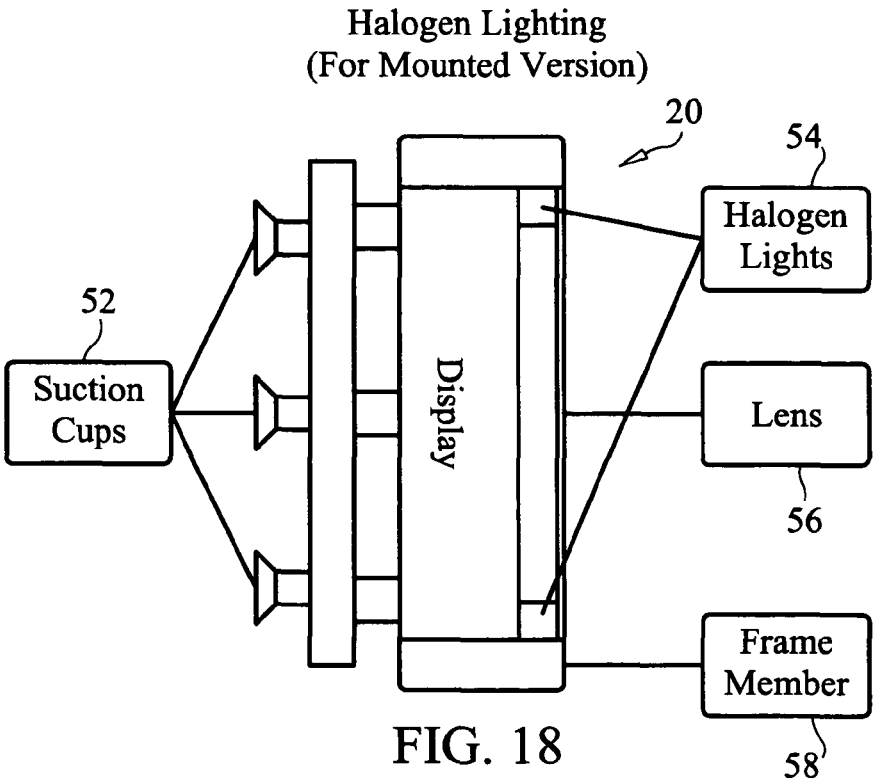
FIGS. 18-21 are schematic representation of various embodiments and/or structural modifications of a halogen lighting system associated with the various embodiments of the display system of the present invention.

With primary reference to FIG. 18, the LCD display of the display assembly 20 may assume a different configuration than represented in FIG. 10. Structural modification of the LCD as represented in FIG. 18 is primarily, but not exclusively, due to the fact that it is disposed on the exterior of the vehicle 10 adjacent to or in structural cooperation with the rear view window 23. As such, additional structural features of the display assembly 20 may include its removal attachment to the rear view window 23 by a plurality of suction cups 52 secured to the back or rear side of the display assembly 20. Additional structural features associated with the embodiment of the display assembly 20 as represented in FIG. 18 include halogen lighting 54, appropriate lens structure 56, and a supporting frame member 58 operationally similar to the embodiment of FIG. 10 but structurally distinguishable therefrom.

Figure 19:
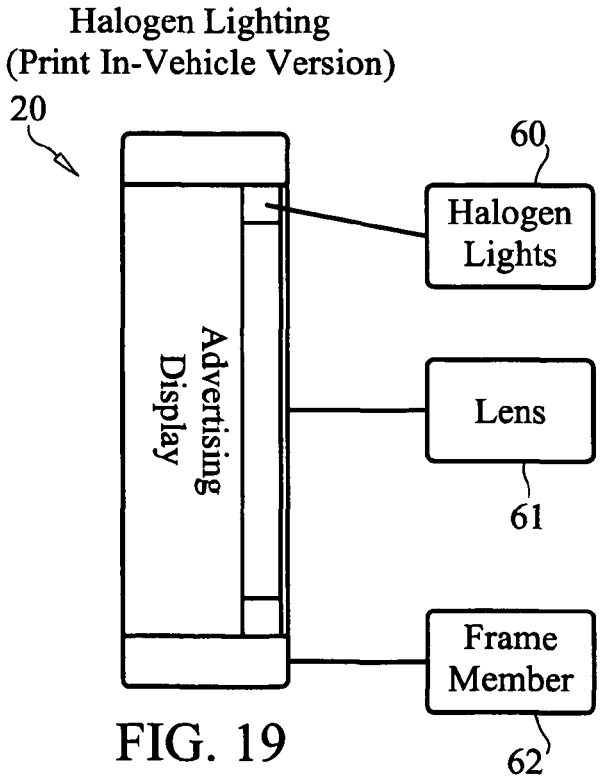
Figure 20:
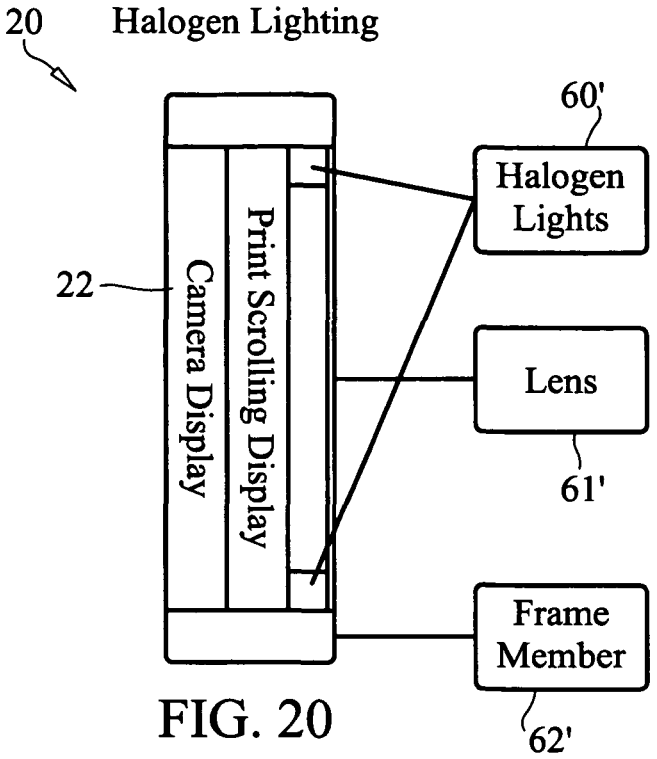

As indicated above, specific structural features of the display assembly 20, when defined by an LCD display assembly may vary. Such structural features are at least partially dependent on the specific application for which the display assembly 20 is utilized as well as the location of the display assembly 20 on the vehicle 10. Further by way of example, FIGS. 19 and 20 represent additional structural modifications and/or embodiments. More specifically, in FIG. 19 the display assembly 20 is structurally and operationally similar to that represented in FIG. 18 and includes appropriate halogen lighting as at 60, a lens system 61 which facilitates viewing from an exterior location and a supporting frame member 62 as previously represented.

FIG. 20 represents yet additional structural features of the display assembly 20, defined by an LCD display structure also including halogen lighting assembly 60' an appropriate lens assembly 61 and a supporting and interconnecting frame assembly 62'. As further represented in the embodiment of FIG. 20 a camera display 22 may be directly connected to the display assembly 20 such as by being mounted on a rear or back side thereof. Such an embodiment is primarily used wherein the display assembly 20 is directly associated with the rear view window 23 of the vehicle 10 as set forth above.

Figure 21:
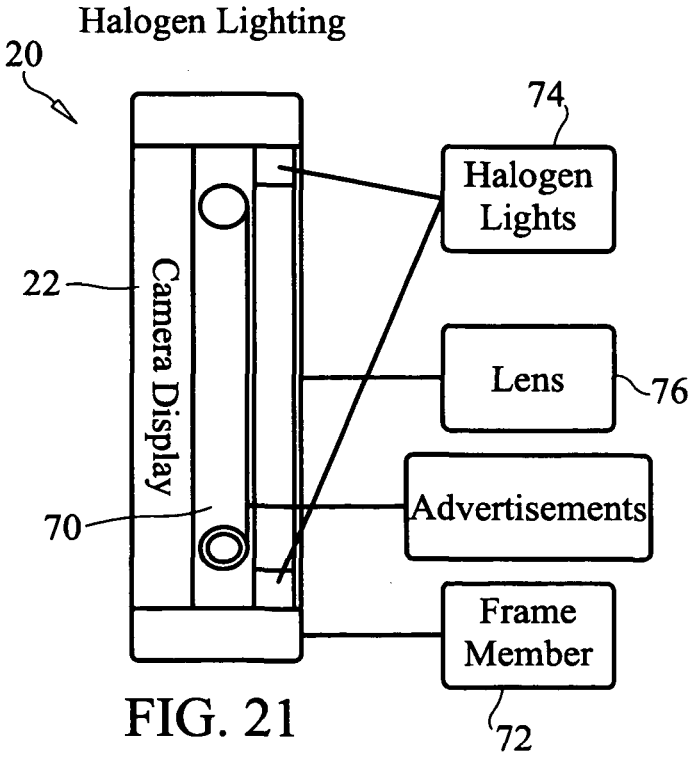
Figure 22:
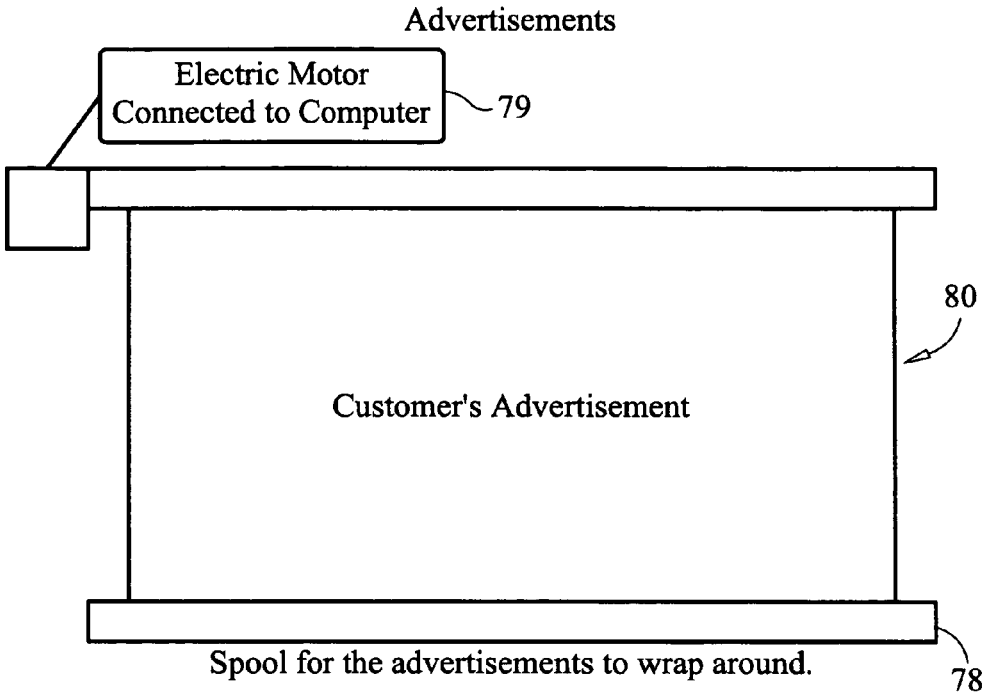
FIGS. 22-25 are schematic representations of advertisements and a sequential display thereof associated with at least some of the various embodiments of the display system of the present invention.

Yet another preferred embodiment of the display system of the present invention includes the aforementioned print in-vehicle scroll assembly schematically represented in part in FIGS. 21-25. Moreover, the display assembly 20 of this preferred embodiment as shown in FIG. 21 includes a scrolling billboard display generally indicated as 70 mounted in a common supporting frame 72 having appropriate lighting, such as halogen lighting 74 and a lens assembly 76. As set forth in at least some of the additional preferred embodiments of the display system of the present invention, the camera display 22 may be associated directly with the scrolling billboard display assembly 70. Alternatively, the camera display 22 may be located at various other parts of the vehicle 10 as represented in FIGS. 6-9. The scrolling billboard display assembly 70 associated with the print in-vehicle scroll assembly embodiment of the present invention may or may not be "built in" or otherwise directly associated with the rear view window 23 and one or more other windows of the vehicle 10 and comprises a rotating element and drive motor 78 and 79 respectively as schematically represented in FIG. 22. As will also be explained in greater detail hereinafter, the electric drive motor 79 may be connected to and at least partially regulated or controlled by a computer or processor facility.

Figure 23:
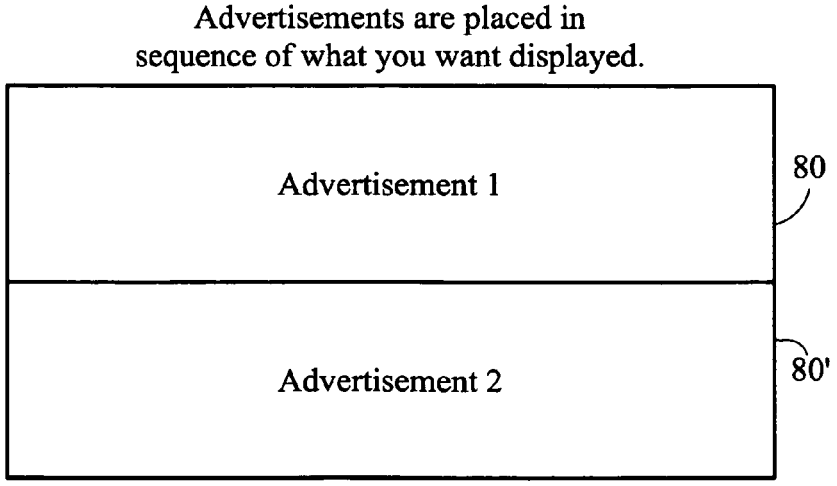
Figure 24:
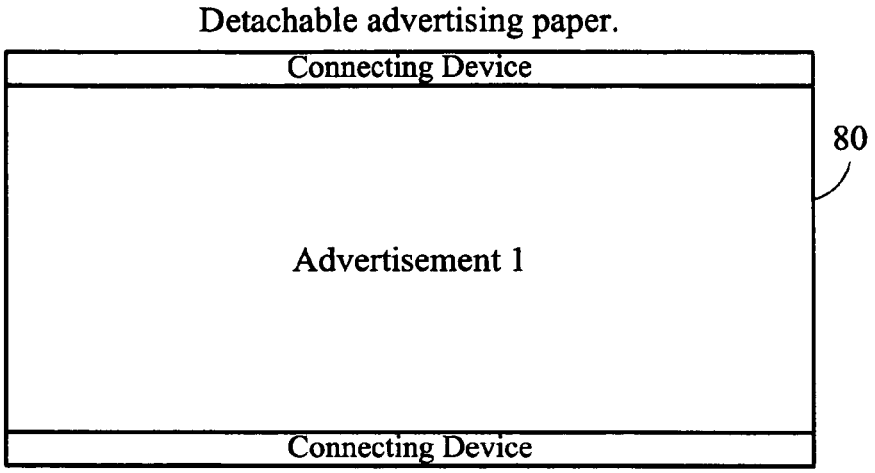
Figure 25:
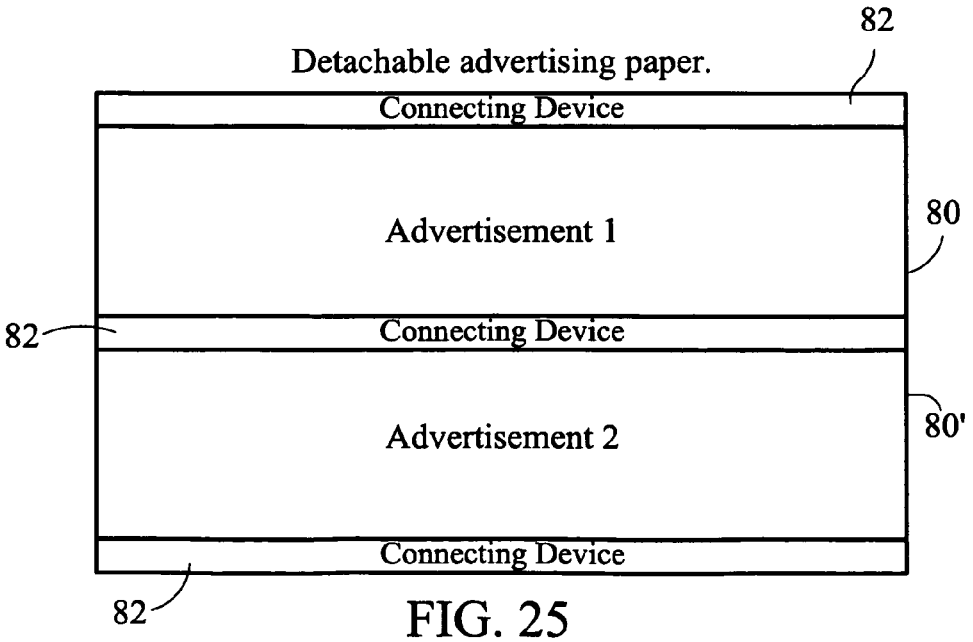
Figure 26:
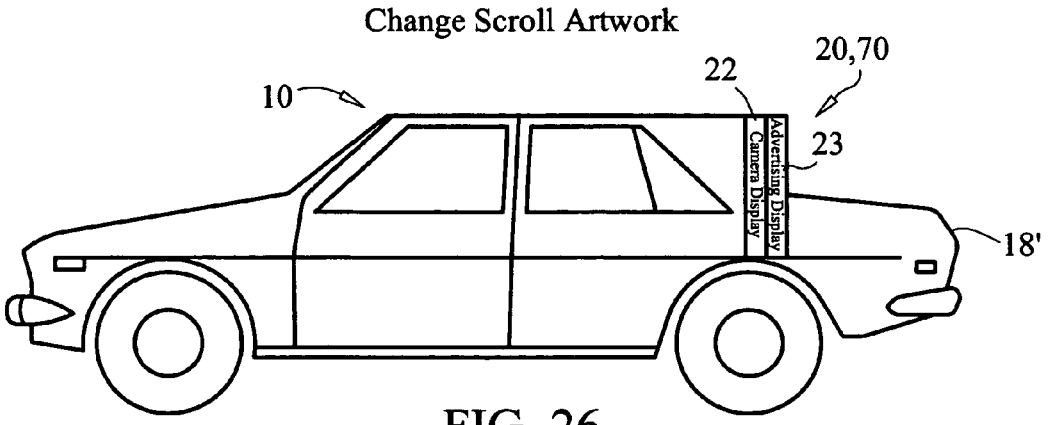
FIGS. 26-29 are schematic representations of a change scroll art work structural modification and embodiment associated with additional embodiments of the display system of the present invention.
Figure 27:
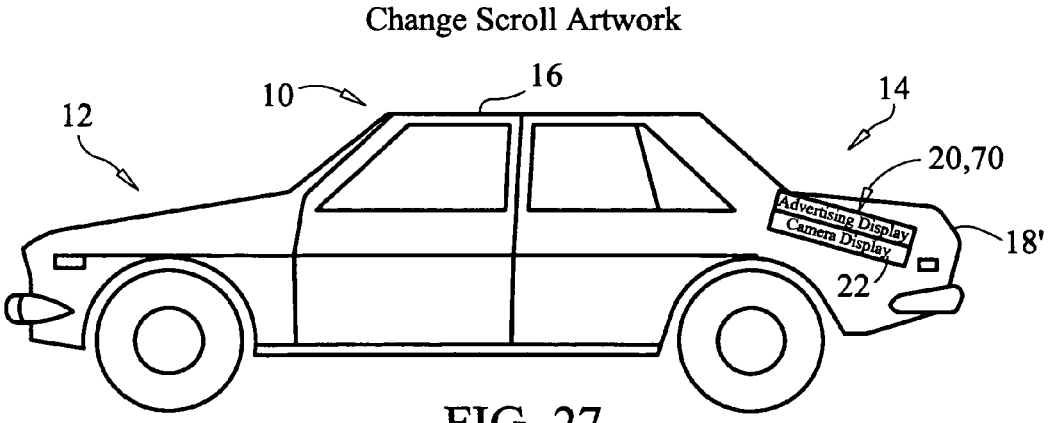
Figure 28:
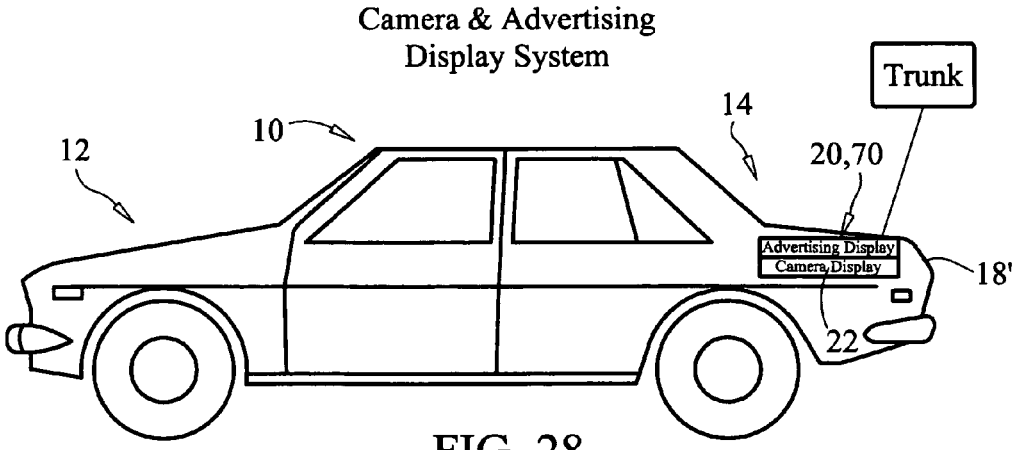
Figure 29:
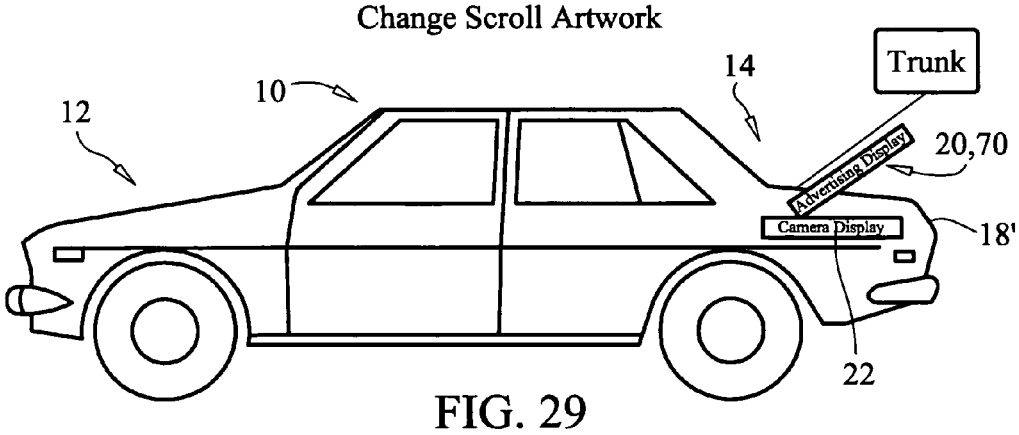

In addition, a print display of the customer's advertisements generally indicated as 80 is structured to present multiple print advertisements and/or communications through cooperative structuring and operation of the spool assembly 78 and the electric drive motor 79. As such, advertisements or messages are displayed according to a predetermined schedule that the user/advertiser develops. Similarly, the advertiser will define the order of the presentation as well as the time duration of each advertisement as schematically represented in FIG. 23. Further, appropriate interconnection of the front advertisements 80, 80', etc. may be accomplished by appropriate connecting devices 82 as demonstrated in FIGS. 24 and 25. Further structural features associated with the print in-vehicle scroll assembly may include the various advertisements 80, 80', etc. utilizing what may be referred to as "advertising print paper". As such, the print paper is made of durable, flexible and preferably reflective material. Such material may take the form of a composite polymer material and be customized in terms of configuration and dimension so that variable amounts of advertisements can be properly displayed and stored. Further, the dimension and configuration of the print paper or other form of the customer's advertisements 80, 80' is dependent, at least in part, on the vehicle's window dimension and configuration. Further structural and operative features may be the utilization of displayed "tint" and may be varied selectively by the vehicle operator or other vehicle personnel by activating a "tint mode".

Another feature evidencing the versatility of the print in-vehicle scroll assembly includes manipulation of the scrolling billboard display assembly 70. More specifically, the advertisements, art work, etc. associated with the billboard display assembly 70 can be easily changed by the user, as schematically represented in FIGS. 26-29. As such, when in the operative position of FIG. 26, the display assembly 20 including, but not limited to, the embodiment incorporating the scrolling billboard assembly 70 may be moved from the operative position of FIG. 6 through a successive path of travel by activating appropriate structure and mechanical linkage associated with the mounting assembly, as set forth above. As such, the display assembly 20 is moved from its operative position of FIG. 26 into a storage and access area 18, such as the trunk space of the vehicle 10. Once so disposed, the display assembly 20 and/or scroll assembly 70 may be removed through the trunk area 18' for purposes of maintenance, repair, advertisement and/or artwork changing etc.

Yet another preferred embodiment of the display system of the present invention includes the preferred embodiment comprising the print outside scroll assembly. Structural features of this embodiment are generally similar to a combination of the above noted embodiments but are not limited thereto. More specifically, the print outside scroll assembly may include the display assembly 20 located on the exterior of the vehicle 10 adjacent to or in cooperation with the rear-view window 23. Storage of this embodiment of the display assembly 20, with or without the directly associated camera display 22, may occur by placing the display assembly 20 in an auxiliary storage compartment on the roof of the vehicle 10 as at 49 or 49' or in the trunk 18 or 18'. Movement of the display assembly 20 is by an appropriately structured mounting assembly generally indicated as 46 including an appropriate mechanical linkage 48 as represented in FIG. 11. Alternatively, the mounting assembly 46' may be utilized including the linkage 48' incorporating the mechanical arms 51. As described with reference to FIGS. 14 and 15, the mounting assembly 46' is structured and selectively operable to position the display assembly 20 in its various forms between the stored position on the interior of the auxiliary compartment 49' and its operative position adjacent to or in direct association with the rearview window 23.

Yet additional preferred embodiments of the present invention are represented in FIGS. 30-45 and are directed to a display system designed to be mounted on or directly associated with a vehicle 10' of the type which does not include conventional, segregated storage space, such as trunk. More specifically, such vehicles include, but are not limited to, SUVs, vans, etc. wherein a rear window 23' disposed on or adjacent the back of the vehicle 18' and further wherein the vehicle 10' comprises a rear door 25 on which the rear window 23' may or may not be retractably mounted.

Figure 30:
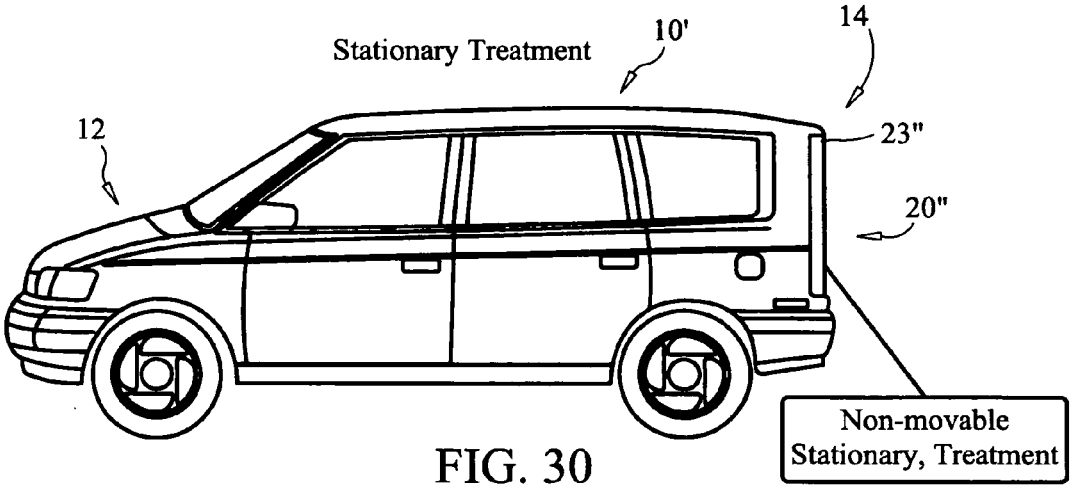
FIGS. 30 and 31 are schematic representations of another preferred embodiment of the display system of the present invention directed to the operative mounting of a display assembly on a vehicle such as sports utility vehicle, van or other type of vehicle absent traditional trunk storage, wherein the display assembly is stationary.
Figure 31:
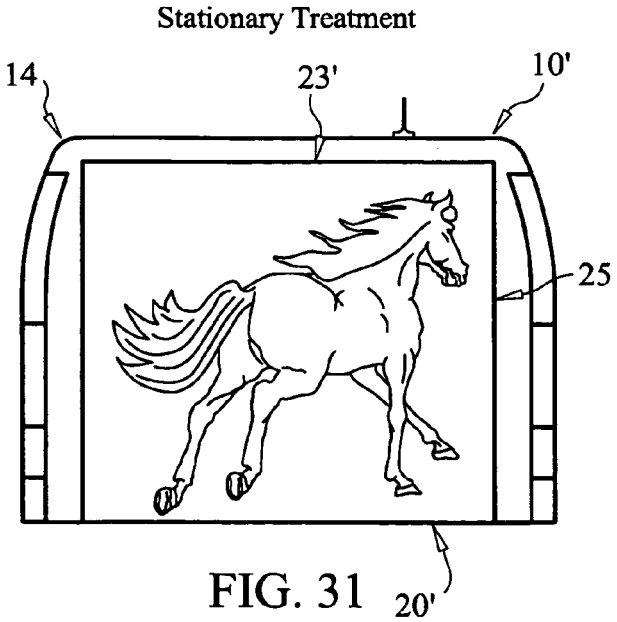

Accordingly, the embodiment of FIGS. 30 and 31 are directed to a display assembly comprising the vehicle 10' including a front portion 12, a rear portion 14 but being absent a trunk or conventional storage area. Instead, the rear portion of the vehicle 14 normally has an interior space which is typically occupied by additional seating or represents a storage area directly within the passenger cabin. Therefore, in this embodiment the display assembly 20' includes an electronic digital display, of the type set forth in greater detail herein, which is mounted on and directly associated with the rear window 23'. In the embodiment of FIGS. 30 and 31 the rear window 23' is fixed. As such, the display assembly is directly associated with and/or mounted on the rear window 23' and is not capable of being selectively or physically moved between an operative or viewing position as represented in FIG. 31 and a stored position, as represented with the above noted preferred embodiments.

Figure 32:
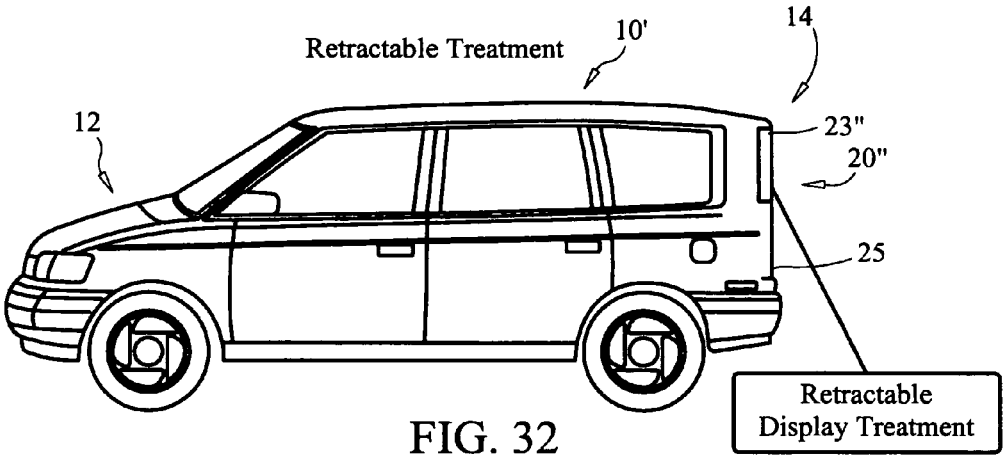
FIGS. 32-45 are schematic representations of yet another preferred embodiment of the display system of the present invention generally similar to the embodiment of FIGS. 30 and 31 in association with a vehicle absent conventional trunk space and which includes a retractable treatment feature.
Figure 33:
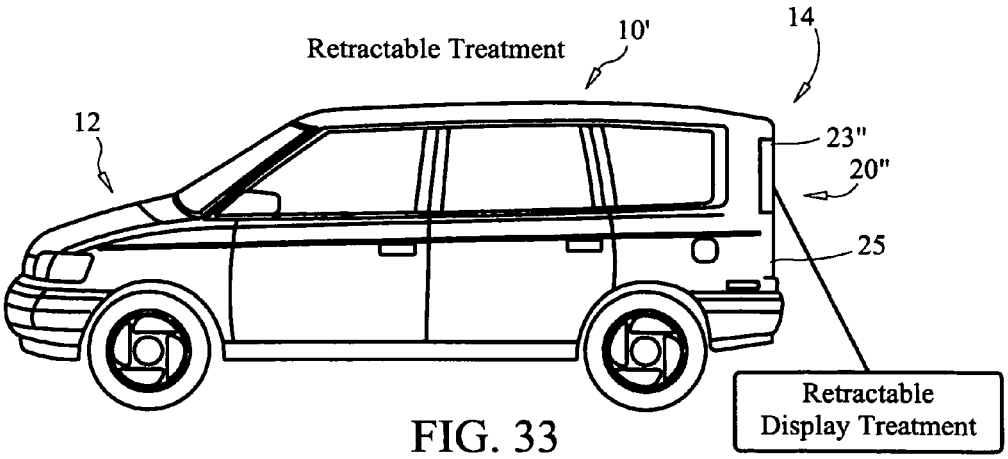
Figure 34:
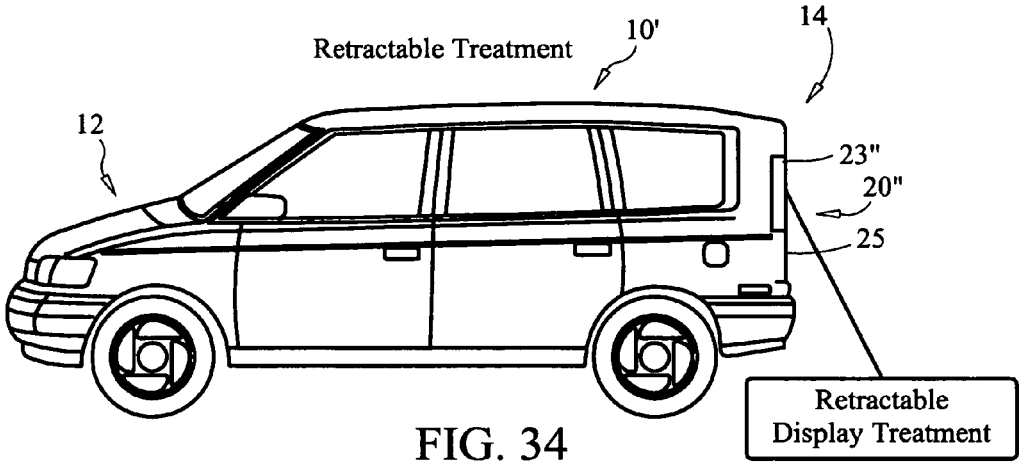
Figure 35:
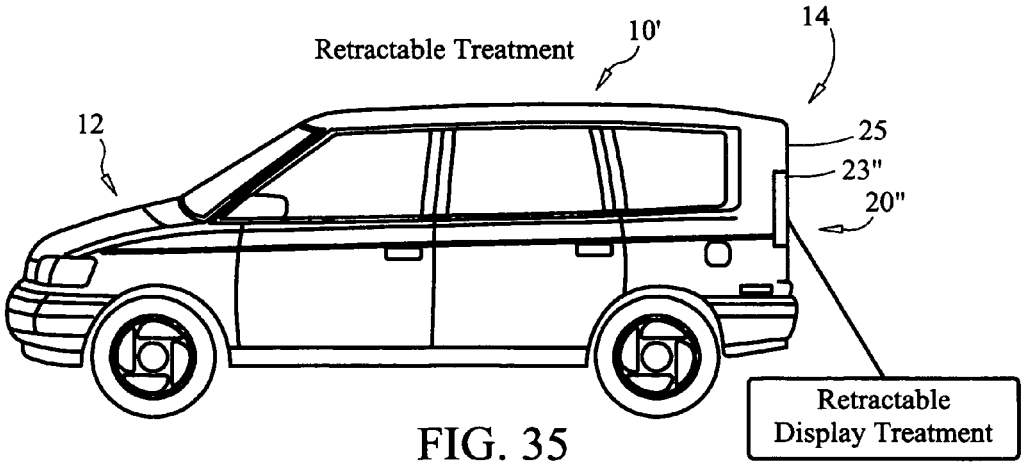
Figure 36:
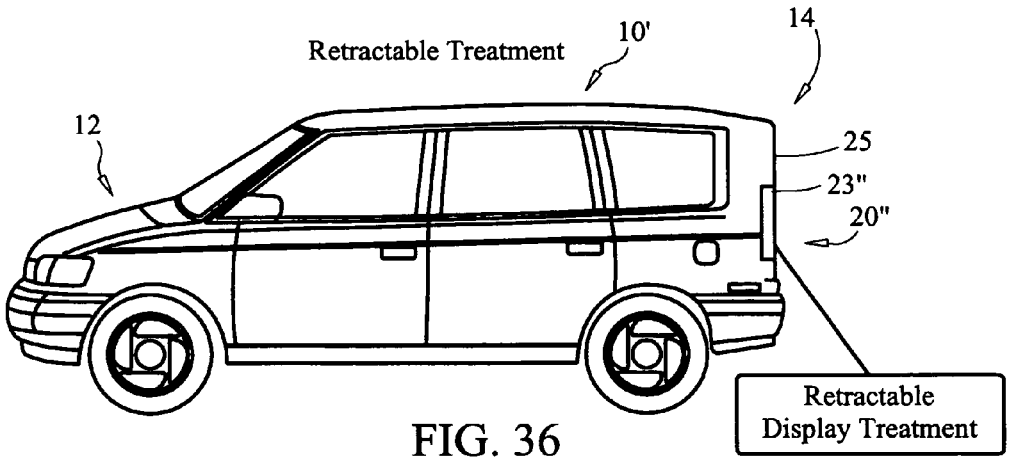
Figure 37:
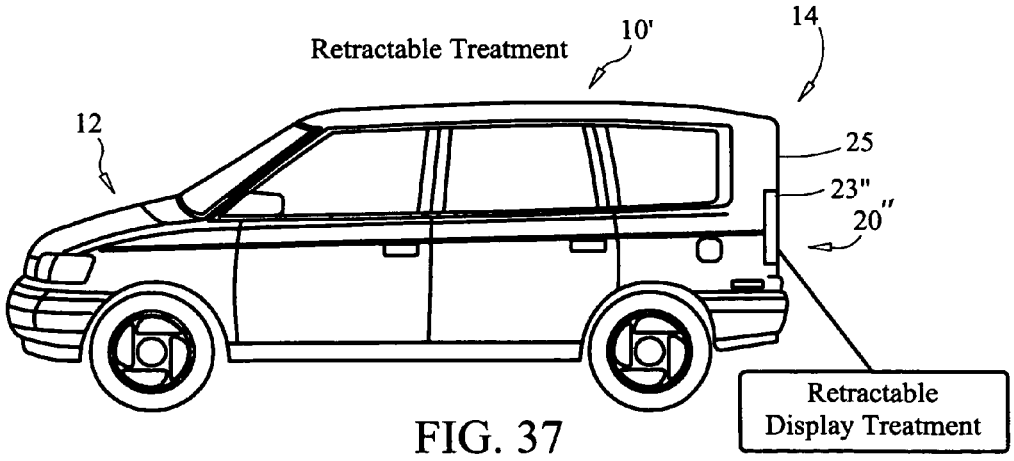
Figure 38:
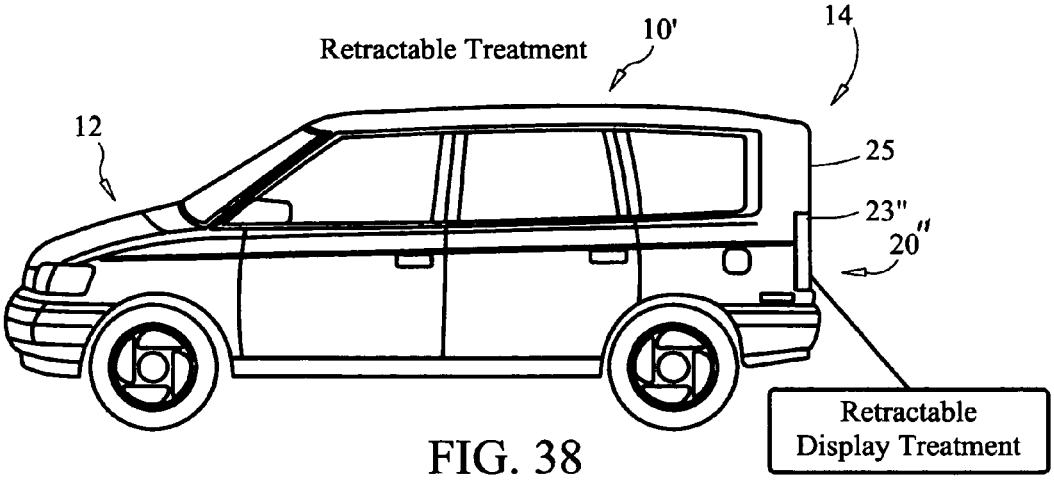
Figure 39:
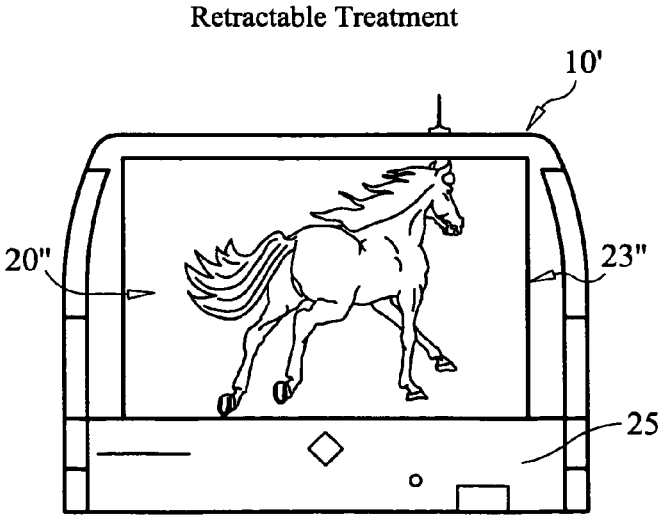
Figure 40:
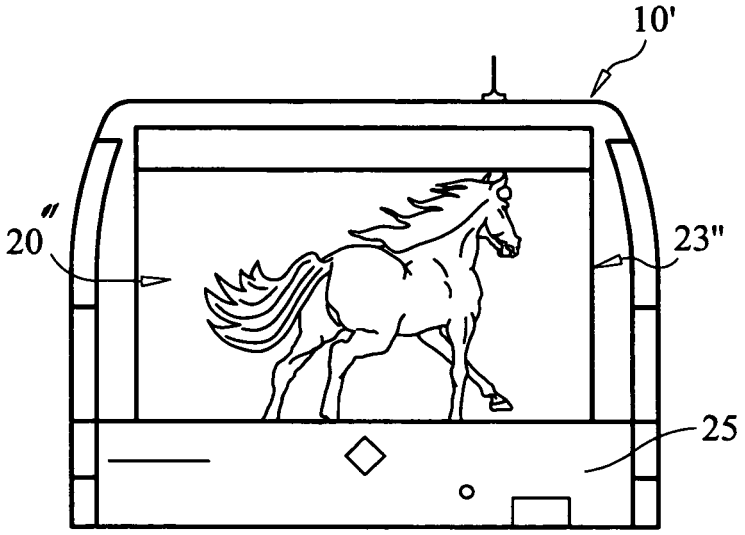
Figure 41:
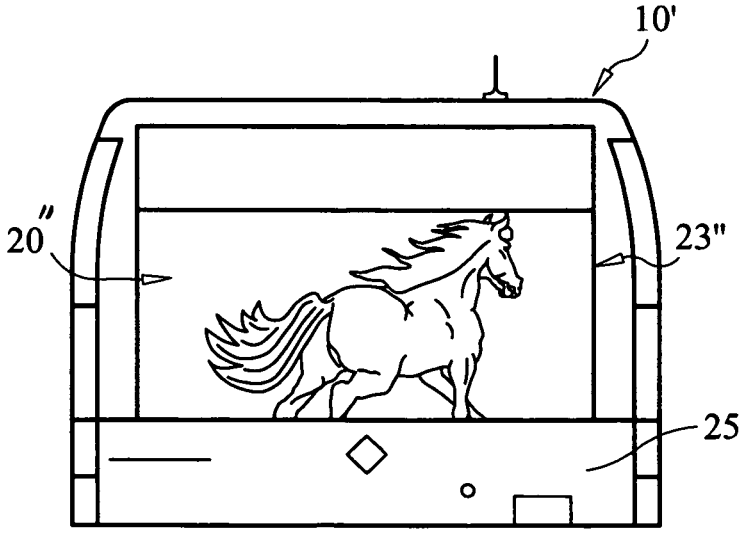
Figure 42:
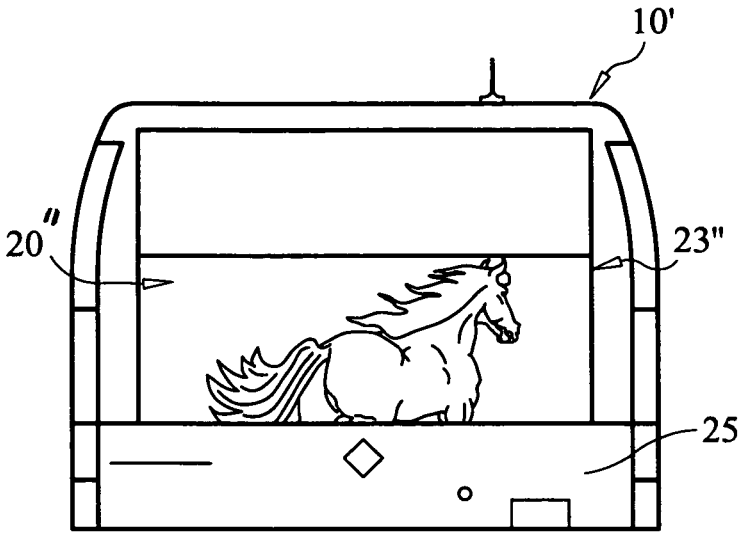
Figure 43:
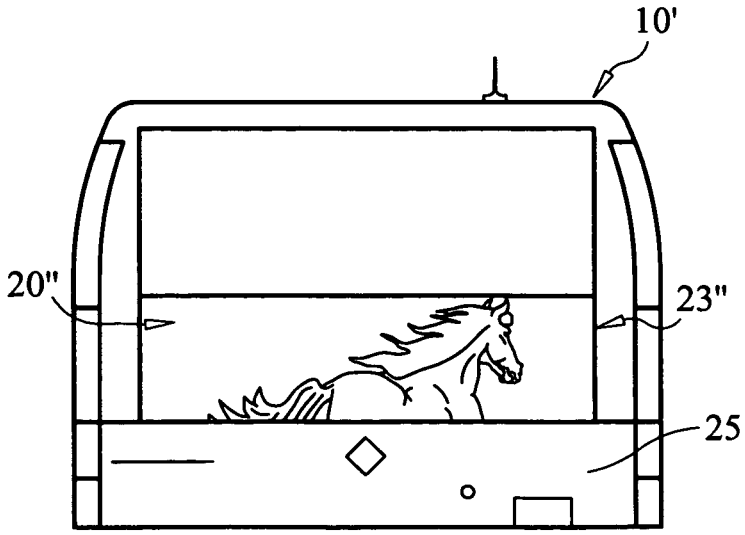
Figure 44:
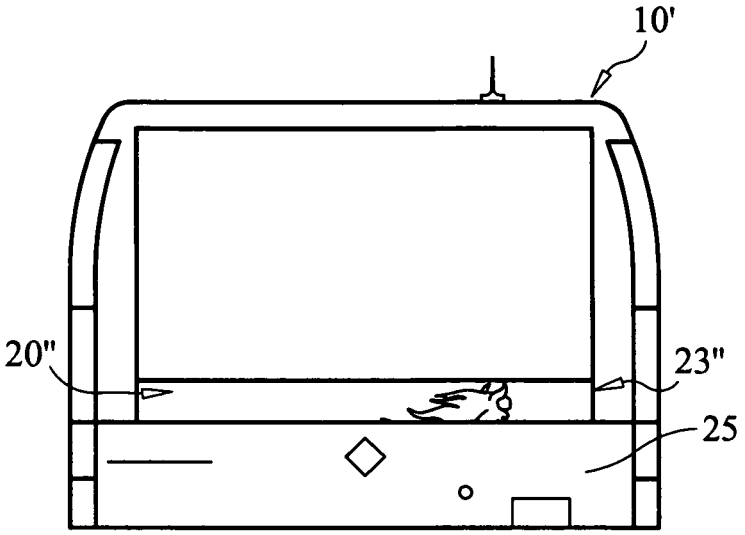
Figure 45:
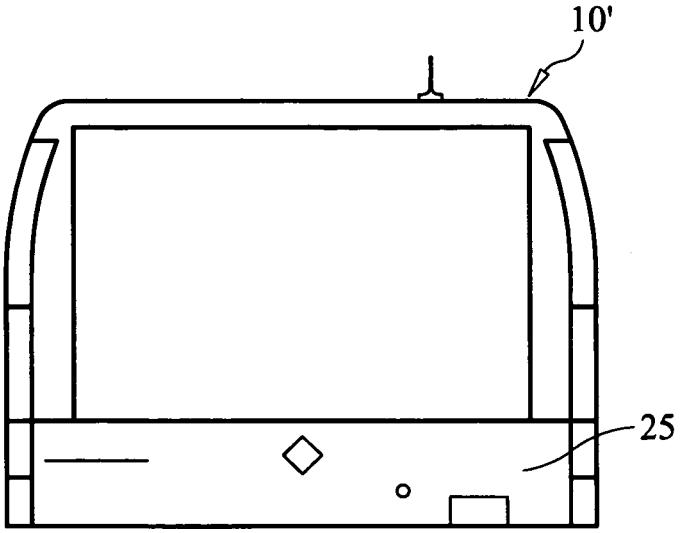
Figure 46:
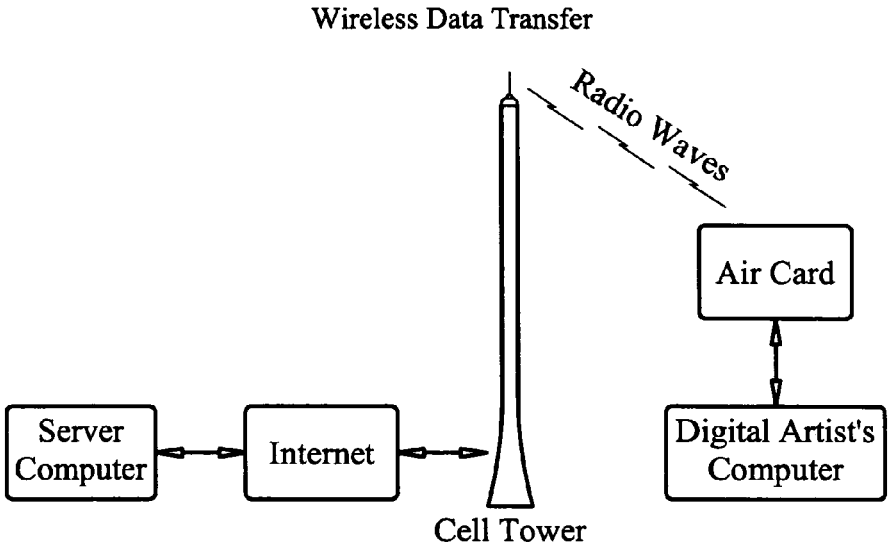
FIG. 46 is a schematic representation of a communication aspect of the display system of the present invention related to wireless data transfer.
Figure 47:
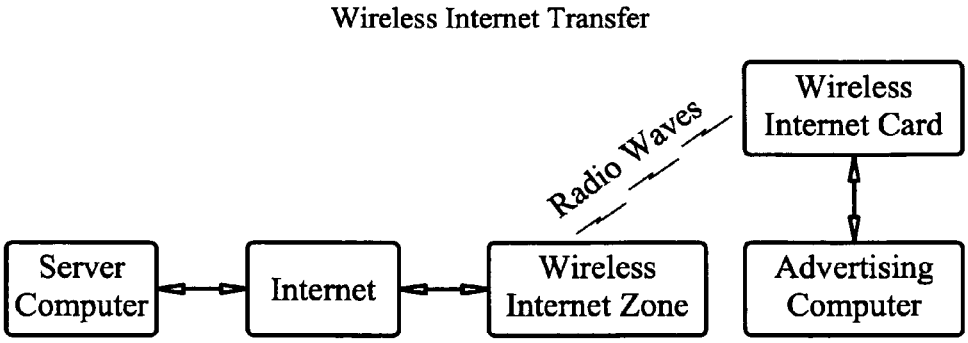
FIG. 47 is a schematic representation of a communications aspect of the present invention directed to wireless internet transfer.

Somewhat similarly, the additional preferred embodiment of FIGS. 32-45 represent a vehicle 10' such as an SUV, van, etc. absent a conventional trunk space for storage. However, the display system of this embodiment includes the display assembly 20" mounted within the rear door 25 as schematically represented in FIGS. 32-38 and more descriptively represented in the pictorial displays of FIGS. 39-45. Accordingly, a mounting assembly for retracting the rear window 23" is associated with the display assembly 20" but is not specifically represented in the embodiment of FIGS. 32-45. As such, the mounting assembly may be operatively defined by the conventional retracting assembly associated with the vehicle 10', which serves to selectively position the rear window 23" into the fully extended, "closed" as represented in FIGS. 32 and 39 or the fully retracted or open position as represented in FIGS. 38 and 45.

As set for the herein, the display assembly 20" is in the form of an electronic, digital display assembly similar to or substantially equivalent with the display assemblies 20 represented in the above noted figures. Also, a variety of different display structures and facilities may actually be utilized. However, distinguishing features of the embodiment of FIGS. 30 and 31 and the additional embodiment of FIGS. 32-45 is that the compact nature of the structural features associated with the display assembly 20" is its ability to be mounted within the rear door 25 of the vehicle 10'. As such, the viewable display screen or display assembly 20" is mounted on, within or otherwise directly and operatively associated with the rear window 23". As such, the movement of the window 23" into and between the fully open and operative, viewing position of FIGS. 32 and 39 and the fully closed or retracted position of FIGS. 38 and 45 concurrently moves the display screen or like display facilities defining the display assembly 20". Therefore, a successive review of the FIGS. 32-38 present a schematic representation of the sequential movement of the rear window 23" and the display assembly 20" from the fully observable and operative position represented in FIGS. 32 and 39 to the fully closed and retracted position as represented in FIGS. 38 and 45.

In order to provide adequate safety features associated with the additional preferred embodiments of FIGS. 30-45, a viewing assembly including one or more viewing cameras may be mounted on the vehicle 10' in any appropriate location. As set forth above, appropriate observation may thereby be made from the interior of the vehicle 10' if and when the display assembly 20', 20" and/or the rear window 23', 23" are structured in a manner which interferes with the rear viewing of the vehicle by the operator. The structural and operative features of the viewing assembly may be the same or appropriately modified as represented in the description of the viewing assembly associated with the other embodiments of the present invention.

Yet additional features of the display system of the present invention is operable with one or more of the above noted preferred embodiments and is schematically represented in FIGS. 46-49. As defined, such additional features, if warranted, allows an operator to place advertisements on a scheduled cycle. In addition, billing invoices and like administrative matters may be generated according to the activity of the advertisement displayed. Also, and with further primary reference to FIGS. 46-49, wireless data transfer; wireless internet transfer, data transfer port structures and server connections facilitating wireless communication with advertising data bases and associated advertising and administrative processor facilities may be incorporated in or rendered accessible by various additional preferred embodiments of the display system of the present invention. As schematically represented, a tiered, system controlled network may include a plurality of fixed stations which transmit message content and scheduling data to a controller and which generates billing and other accounting records, as set forth above. Cooperative software associated with applicable computer and processor assemblies and/or applications allows specifically encoded data by a designer to be downloaded. The software and/or processor facilities control which advertisements are to be displayed as well as duration, etc. Software further has memory capabilities capable of storing such advertisements.

Yet additional features associated with one or more of the above noted preferred embodiments included in the display system of the present invention include a computer display screen control assembly as aforementioned and as schematically and descriptively represented in FIG. 50. As such, the control assembly includes control buttons accessible to an operator and which include a motor button, motor stop button, manual mode, automatic mode, pin button, and emergency power-off button. System status facilities associated with the control assembly of FIG. 50 include manual mode, automatic mode, advertising display stored, advertising display deployed, pins locked and pins unlocked.

Further associated with the control assembly of FIG. 50 is a system deactivation mode. The system deactivation mode allows the user to deactivate the system in a variety of different ways. By way of example, a user or operator can press the power-down system button to completely turn off all power to the display and have the mechanical assembly become stationary or retract into the vehicle's trunk, as set forth above. The operator can press "tint mode", as also set forth above so as to display a predetermined color that matches the color of the vehicle tint. This color is continuously displayed on the advertising display 20 in at least some of the above noted preferred embodiments. The system deactivation mode menu which may be associated with the control assembly of the embodiment of FIG. 34 also includes additional features of the power-up system and activation member to turn on power to the system and the "edit colors" tint mode structured to edit what colors are projected on the display assembly 20.

Figure 53:
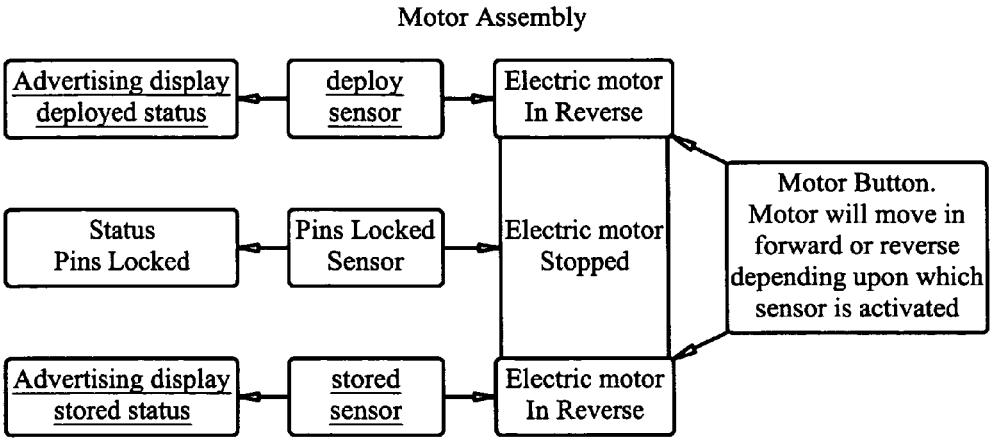
Figure 54:
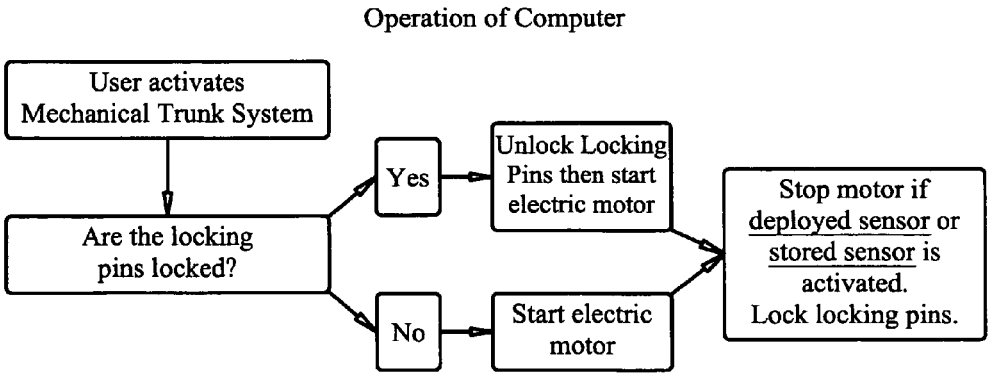

With regard to FIGS. 51-53, additional operational steps are represented and relate primarily, but not exclusively to the manual deployment and manual retraction of the display assembly 20 in at least some of the above noted preferred embodiments. As represented, and in operation an operator presses a pin button to unlock the locking pins associated with the system, thereafter, an operator presses the motor button to activate electric motors to deploy the display assembly 20. The motors are automatically stopped by the deploy sensor when the sign is deployed to its fullest operative position. An operator may press the pin button for locking pins to lock the display assembly 20 into its operative position.

To manually retract the display assembly 20 an operator presses the pin button to unlock the locking pins. Thereafter the operator presses the motor button to activate an electric motor. The deployed sensors sense when the motor is operating in reverse so that the advertising display is retracted and put into an appropriate storage area 49 or 49'. The driving electric motor is stopped by another mechanical sensor which may be referred to as a "stored sensor" when it can be locked down into the storage area 49 or 49'. Mechanical sensors turn on the advertising display stored status associated with the control assembly and the operator can subsequently press the pin button to lock the advertising display into its stored position.

Accordingly, the various preferred embodiments as set forth herein represent significant advancements in the art of mobile advertisement, wherein the display system of the present invention can be adapted to a variety of mobile applications including vehicles of various types, sizes and purposes.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. Apparatus comprising:

a vehicle including a rear window, a rear view mirror, and a window opening extending around the rear window, a display mounting assembly;

a display device attached to the vehicle by the display mounting assembly, wherein the display device is held within the window opening, wherein the display device includes an outer surface, upon which at least one message is displayed, facing outward from the vehicle and an inner surface facing inward, into the vehicle, and wherein the display device is disposed within the window opening; and a viewing system including a camera and a camera display screen, wherein the camera is connected to the vehicle for observation of an area, exterior to the vehicle, obstructed from a direct view of an operator of the vehicle by the display device within the window, wherein the camera display screen is disposed to extend along the inner surface of the display device, being visible to the operator of the vehicle through the rear view mirror providing a view of the obscured area exterior to the vehicle.

2. The apparatus of claim 1, wherein the display device includes a digital display screen.

3. The apparatus of claim 2, wherein the digital display screen includes a liquid crystal display (LCD).

4. The apparatus of claim 2, wherein the display mounting assembly holds the digital display screen in a fixed position to form a portion of an exterior surface of the vehicle.

5. The apparatus of claim 4, wherein the peripheral edge of the digital display screen is disposed to be flush with the edge around the window opening of the vehicle.

6. The apparatus of claim 4, wherein the digital display screen includes a liquid crystal display (LCD).

7. The apparatus of claim 2, wherein the vehicle additionally includes a storage space disposed below the window opening, and the display mounting assembly additionally moves the digital display screen downward, to be held in a stored position within the storage space, and upward from the storage space to be returned to the window opening.

8. The apparatus of claim 7, wherein, when the display screen is held within the window opening, the display screen forms a part of the exterior surface of the vehicle.

9. The apparatus of claim 7, wherein the vehicle additionally includes a transparent glass window within the window opening; and the display screen is held inwardly, within the vehicle, from the display screen.

10. The apparatus of claim 1, wherein the display device includes signage forming the at least one message, held in place on an outer surface of the display device.

11. The apparatus of claim 1, wherein the display device includes:

signage movably attached within the display device, forming a plurality of the messages at different locations on the signage, and a motor moving the signage so that the various messages are individually displayed.

12. The apparatus of claim 11, wherein the signage is formed as a scroll movable from one roll to another.

13. The apparatus of claim 1, wherein the vehicle additionally includes a storage portion, and the display device is retractable, being movable in either direction between an operative position within the window opening and a stored position within the storage portion.

14. The apparatus of claim 1, additionally comprising processor facilities, including wireless application protocol, said processor facilities structured to include wireless download/upload capabilities for data transfer communication with at least one remote processing facility, wherein said download/upload capabilities are structured to receive and transmit advertisement data for scheduled display on said display assembly.

15. The apparatus of claim 14, additionally comprising a solar power system including battery storage, providing electrical power for the processor facilities.

* * * * *